United States Patent [19]

Crochiere et al.

[11] 4,184,049

[45] Jan. 15, 1980

[54] TRANSFORM SPEECH SIGNAL CODING WITH PITCH CONTROLLED ADAPTIVE QUANTIZING

[75] Inventors: Ronald E. Crochiere, Berkeley Heights, N.J.; Jose M. N. S. Tribolet, S. Domingos de Rana, Portugal

[73] Assignee: Bell Telephone Laboratories, Incorporated, Murray Hill, N.J.

[21] Appl. No.: 936,889

[22] Filed: Aug. 25, 1978

[51] Int. Cl.[2] ..... G10L 1/00

[52] U.S. Cl. ..... 179/1 SA

[58] Field of Search ..... 179/1 SA, 1 SC, 1 SM

[56] References Cited

U.S. PATENT DOCUMENTS

| | | | |
|---|---|---|---|
| 3,681,530 | 8/1972 | Manley et al. | 179/1 SA |
| 4,142,071 | 2/1979 | Croisier et al. | 179/1 SA |

OTHER PUBLICATIONS

R. Zelinski et al., "Adaptive Transform Coding of Speech Signals", IEEE, Trans. on Acoustics etc., Aug. 1977.

*Primary Examiner*—Malcolm A. Morrison
*Assistant Examiner*—E. S. Kemeny
*Attorney, Agent, or Firm*—Jack S. Cubert

[57] ABSTRACT

To improve the speech quality at lower bit rates within a digital communication system in which the coefficients of a frequency transform (e.g. discrete cosine transform) are adaptively encoded with adaptive quantization and adaptive bit-assignment, the adaptation is controlled by a short-term spectral estimate signal formed by combining the formant spectrum and the pitch excitation spectrum of the coefficient signals.

16 Claims, 20 Drawing Figures

COMM CHAN
MPX
QUANTIZER
DELAY
DISCRETE COSINE TRANS. CCT (FIG. 4)
BUFFER REG (FIG. 3)
A/D CONVERTER
FILTER & SAMPLER
ENCODER
CLOCK (FIG. 3)
ADAPTATION COMPUTER (FIG. 13)
NORMALIZER (FIG. 10 & 11)
ADAPTATION CIRCUIT 134
PARCOR PARAMETER COMP. (FIG. 13)
PITCH ANALYZER (FIG. 6)
AUTOCORRELATOR (FIG. 5)
FORMANT SPECTRAL LEVEL GEN. (FIG. 9)
PITCH SPECTRAL LEVEL GEN. (FIG. 7 & 8)
LPC COMPUTER (FIG. 13)
DECODER
CLS
CLA
CLB $P_G = \frac{R_{MAX}}{R(0)}$
609
DIVIDER
R(0)
$R_{MAX}$
$R_1$
607
COMP
603
LATCH
605
LATCH
P
$S_6$
$S_7$
R(1)
601
MPX
R(0)
R(N-1)
620
COUNTER
$S_6$
$S_8$
$P_{MIN}$
621
COMP
$P_{MAX}$
$I_2$
$I_1$
650
CONSTANT GENERATOR
$P_{MIN}$
$P_{MAX}$
630
PG
632
634
PG
635
636
PG
638
PG
640
641
$E_{AC}$
$E_{PA}$
$S_6$
$R_1$
$S_7$
$S_8$
$I_2$
$I_1$ MULTIPLEXOR
901
FFT CIRCUIT
903
E2
SF2
S10
SELECTOR
905
LATCH CLK
907-0
908-0
907-N-1
908-N-1
ReX'FFT(0)
ImX'FFT(0)
ReX'FFT(N-1)
ImX'FFT(N-1)
MULT
910-0
911-0
910-N-1
911-N-1
ADDER
912-0
912-N-1
914-0
914-N-1
σ(0)
σ(N-1)
COMPARATOR
921
N2
J8
J7
COUNTER
920
CLR
INC
S9
S11
PG
930
932
934
936
938
925
FF
927
S
R
A7
A8
ELPC
E2
940
941
943
944
EF
SF2

Y(0)
Y(N-1)
1215-0
LATCH
CLK
1215-N-1
LATCH
CLK
1210
IFFT CIRCUIT
E20
1213
SELECTOR
S31
S14
S31
1221
COMPARATOR
4N
J21
J20
1209
MULTIPLEXOR
1220
CLR
COUNTER
INC
S30
S32
1204-0
1205-0
1204-1
1205-1
1204-N-1
1205-N-1
1204-N
1205-N
1204-N+1
1205-N+1
1204-2N-1
1205-2N-1
1201-0
1201-1
1202-1
1201-N-1
1202-N-1
MULT
YDCT(0)
2√N
YDCT(1)
YDCT(N-1)
√2N Cos π/N
√2N Sin π/N
√2N Cos (N-1)π/2N
√2N Sin (N-1)π/2N
S14
EIDCT
1243
1244
A20
A21
1240
1241
J20
J21
1238
PG
S32
1236
PG
S31
1234
PG
1232
S30
1230
PG
1225
FF
S
R
I
0
EDE
E20
4N
2√N
√2N Cos π/2N
√2N Cos (N-1)π/2N
√2N Sin π/2N
√2N Sin (N-1)π/2N
CONSTANT GENERATOR

TRANSFORM SPEECH SIGNAL CODING WITH PITCH CONTROLLED ADAPTIVE QUANTIZING

BACKGROUND OF THE INVENTION

Our invention relates to digital communication of speech signals, and, more particularly, to adaptive speed signal processing using transform coding.

The processing of speed signals for transmission over digital channels in telephone or other communication systems generally includes the sampling of an input speech signal, quantizing the samples and generating a set of digital codes representative of the quantized samples. Since speech signals are highly correlated, the signal component that is predictable from past values of the speech signal and the unpredictable component can be separated and encoded to provide efficient utilization of the digital channel without degradation of the signal.

In digital communication systems utilizing transform coding, the speech signal is sampled and the samples are partitioned into blocks. Each block of successive speech samples is transformed into a set of transform coefficient signals, which coefficient signals are representative of the frequency spectrum of the block. The coefficient signals are individually quantized whereby a set of digitally coded signals are formed and transmitted over a digital channel. At the receiving end of the channel, the digitally coded signals are decoded and inverse transformed to provide a sequence of samples which correspond to the block of samples of the original speech signal.

A prior art transform coding arrangement for speech signals is described in the article, "Adaptive Transform Coding of Speech Signals," by Rainer Zelinski and Peter Noll, *IEEE Transactions on Acoustics, Speech and Signal Processing,* Vol. ASSP-25, No. 4, August 1977. This article discloses a transform coding technique in which each transform coefficient signal is adaptively quantized to reduce the bit rate of transmission whereby the digital transmission channel is efficiently utilized. The samples of an input speech signal segment are mapped into the frequency domain by means of a discrete cosine transform. The transformation results in a set of equispaced discrete cosine transform coefficient signals. To provide an optimum transmission rate, an estimate of the short term spectrum of the segment is formed responsive to the transform coefficient signals by spectral magnitude averaging of neighboring coefficient signals. The spectrum estimate signal which represents the predicted spectral levels at equispaced frequencies is then used to adaptively quantize the transform coefficient signals. The adaptive quantization of the transform coefficient signals optimizes the bit allocation and step size assignment for each coefficient signal in accordance with the derived spectral estimate. Digital codes representative of the adaptively quantized coefficient signals and the spectral estimate are multiplexed and transmitted. Adaptive decoding of the digital codes and inverse discrete cosine transformation of the decoded samples provides a replica of the sequence of speech signal samples.

In the Zelinski et al transform coding arrangement, the formation of the spectral estimate signal on the basis of spectral component averaging provides only a coarse estimate which is not representative of relevant details of the speech signal in the transform spectrum. At lower bit transmission rates, e.g., below 16 kb/s, the result is a degradation of overall quality evidenced by a distinct speech correlated "burbling" noise in the reconstructed speech signal. In order to improve the overall quality, it is necessary to represent the fine structure of the transform spectrum in the spectral estimate at the lower bit rates.

BRIEF SUMMARY OF THE INVENTION

The aforementioned speech signal degradation in adaptive transform speech processing is overcome by utilizing a vocal tract derived formant spectral estimate of the speech segment transform coefficient signals and a pitch excitation spectral estimate of said speech segment transform coefficient signals to provide the needed fine structure representation. Parameter signals for the bit allocation and step size assignment of the transform coefficient signals of the segment are obtained from the combined formant and pitch excitation spectral estimates so that the adaptative quantization of the transform coefficient signals includes the required fine structure at relevant spectral frequencies. The resulting speech signal transmission is thereby improved even though the transmission bit rate is reduced.

The invention is directed to a speech signal processing arrangement in which a speech signal is sampled at a predetermined rate, and the samples are partitioned into blocks of speech samples. A set of discrete frequency domain transform coefficient signals are obtained from the block speech samples. Each coefficient signal is assigned to a predetermined frequency. Responsive to the set of discrete transform coefficient signals, a set of adaptation signals are produced for the block. The discrete transform coefficient signals are combined with the adaptation signals to form a set of adaptively quantized discrete transform coefficient coded signals representative of the block. The adaptation signal formation includes generation of a set of signals representative of the formant spectrum of the block coefficient signals and the generation of a set of signals representative of the pitch excitation spectrum of the block coefficient signals. The block formant spectrum signal set is combined with the block pitch excitation spectrum signal set to generate a set of pitch excitation controlled spectral level signals. Adaptation signals are produced responsive to the pitch excitation controlled spectral level signals.

According to one aspect of the invention, a signal representative of the autocorrelation of the block transform coefficient signals is generated. Responsive to the block autocorrelation signal, a formant spectral level signal and a pitch excitation spectral level signal is produced at each transform coefficient signal frequency. Each transform coefficient signal frequency formant spectral level signal is combined with the transform coefficient signal frequency pitch excitation spectral level signal whereby a pitch controlled excitation spectral level signal is produced for each discrete transform coefficient signal.

According to yet another aspect of the invention, the pitch excitation spectrum signal generation includes formation of an impulse train signal representative of the pitch excitation of the block transform coefficient signals and the generation of a set of signals each representative of the pitch excitation level at a transform coefficient signal frequency.

According to yet another aspect of the invention, a set of signals representative of the prediction parameters of the block transform coefficient signals is generated responsive to the block autocorrelation signal, and a formant spectral level signal for each transform coefficient signal frequency is formed from the block prediction parameter signals.

According to yet another aspect of the invention, the pitch excitation representative impulse train signal is produced responsive to the block autocorrelation signal by determining a signal corresponding to the maximum value of said block autocorrelation signal and a pitch period signal corresponding to the time of occurrence of said maximum value. A pitch gain signal corresponding to the ratio of said maximum value to the initial value of the block autocorrelation signal is formed. The pitch excitation representative impulse train signal is generated jointly responsive to said pitch gain signal and said pitch period signal.

In accordance with yet another aspect of the invention, the adaptively quantized transform coefficient coded signals are multiplexed with the prediction parameters of the block autocorrelation signal and the pitch period and pitch gain signals. The multiplexed signal is transmitted over a digital channel. A receiver is operative to demultiplex the transmitted signal and adaptively decode the coded adaptively quantized transform coefficient coded signals responsive to the pitch excitation controlled spectral level signals formed from the transmitted prediction parameter signals, the determined pitch gain signal and determined pitch period signal. Responsive to the adaptively decoded transform coefficients, a sequence of speech samples are generated which correspond to a replica of the original speech samples.

According to yet another aspect ot the invention, a bit assignment signal and a step size control signal for each first signal frequency are generated responsive to said pitch excitation controlled spectral level signals. The bit assignment and step size control signals form the adaptation signals operative to adaptively quantize said first signals.

According to yet another aspect of the invention, each first signal is representative of a discrete cosine transform coefficient at a predetermined frequency and each adaptively quantized discrete transform coded signal is an adaptively quantized discrete cosine transform coefficient coded signal.

DETAILED DESCRIPTION

Figure 1:
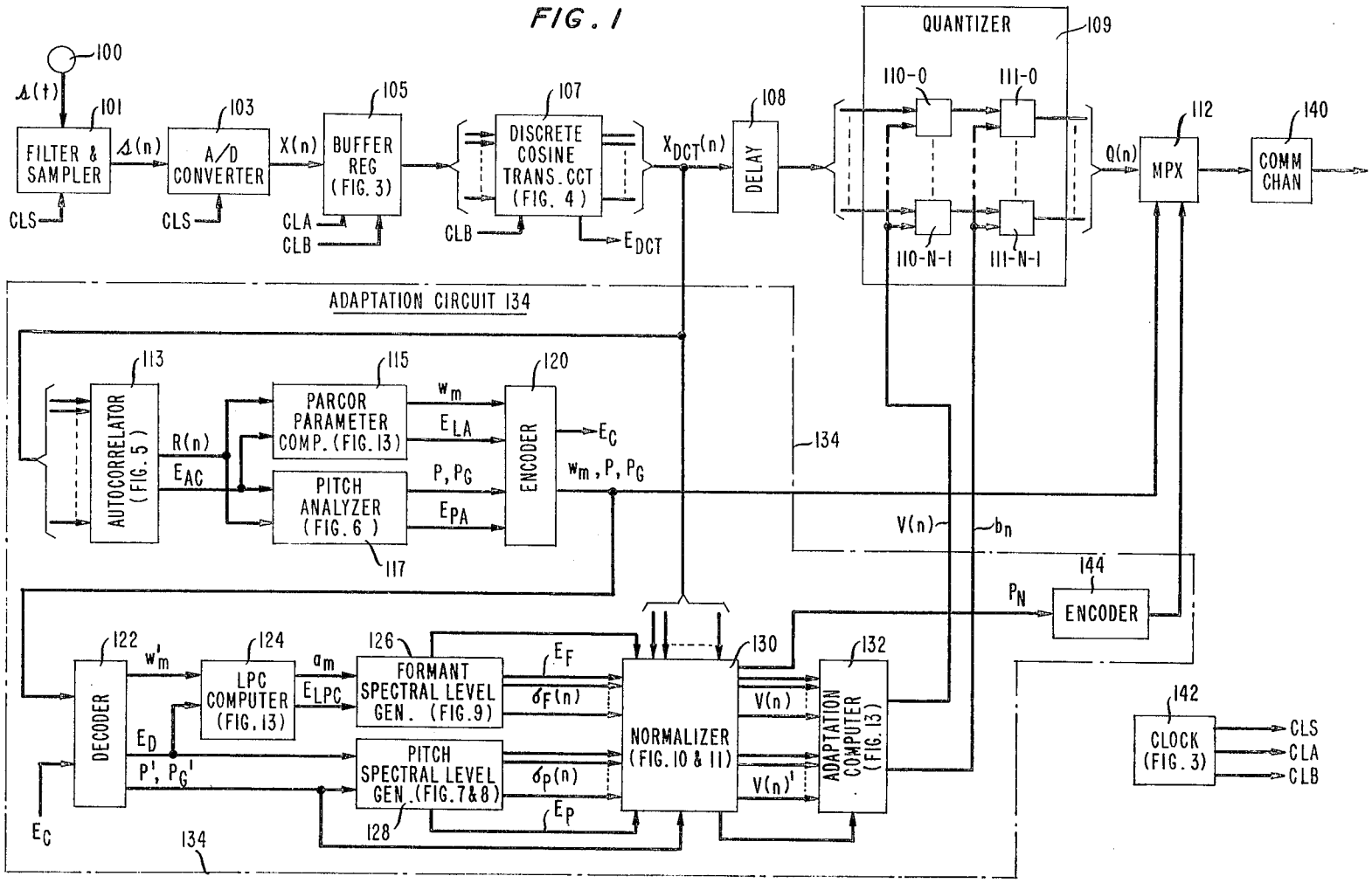
FIG. 1 depicts a general block diagram of a speech signal encoder illustrative of the invention.

FIG. 1 shows a general block diagram of a speech signal encoder illustrative of the invention. Referring to FIG. 1, a speech signal s(t) is obtained from transducer 100 which may comprise a microphone or other speech signal source. The speech signal s(t) is supplied to filter and sampler circuit 101 which is operative to lowpass filter signal s(t) and to sample the filtered speech signal at a predetermined rate, e.g. 8 kHz, controlled by sample clock pulses CLS from clock 142 illustrated in waveform 1901 of FIG. 19. The speech samples s(n) from sampler 101 are applied to analog to digital converter 103 which provides a digitally coded signal X(n) for each speech signal sample s(n). Buffer register 105 receives the sequence of X(n) coded signals from A/D converter 103 and, responsive thereto, stores a block of N signals X(0), X(1), . . . , X(N−1) under control of block clock pulses CLB from clock 140 shown in waveform 1903 of FIG. 19 at times $t_0$ and $t_{11}$.

Figure 3:
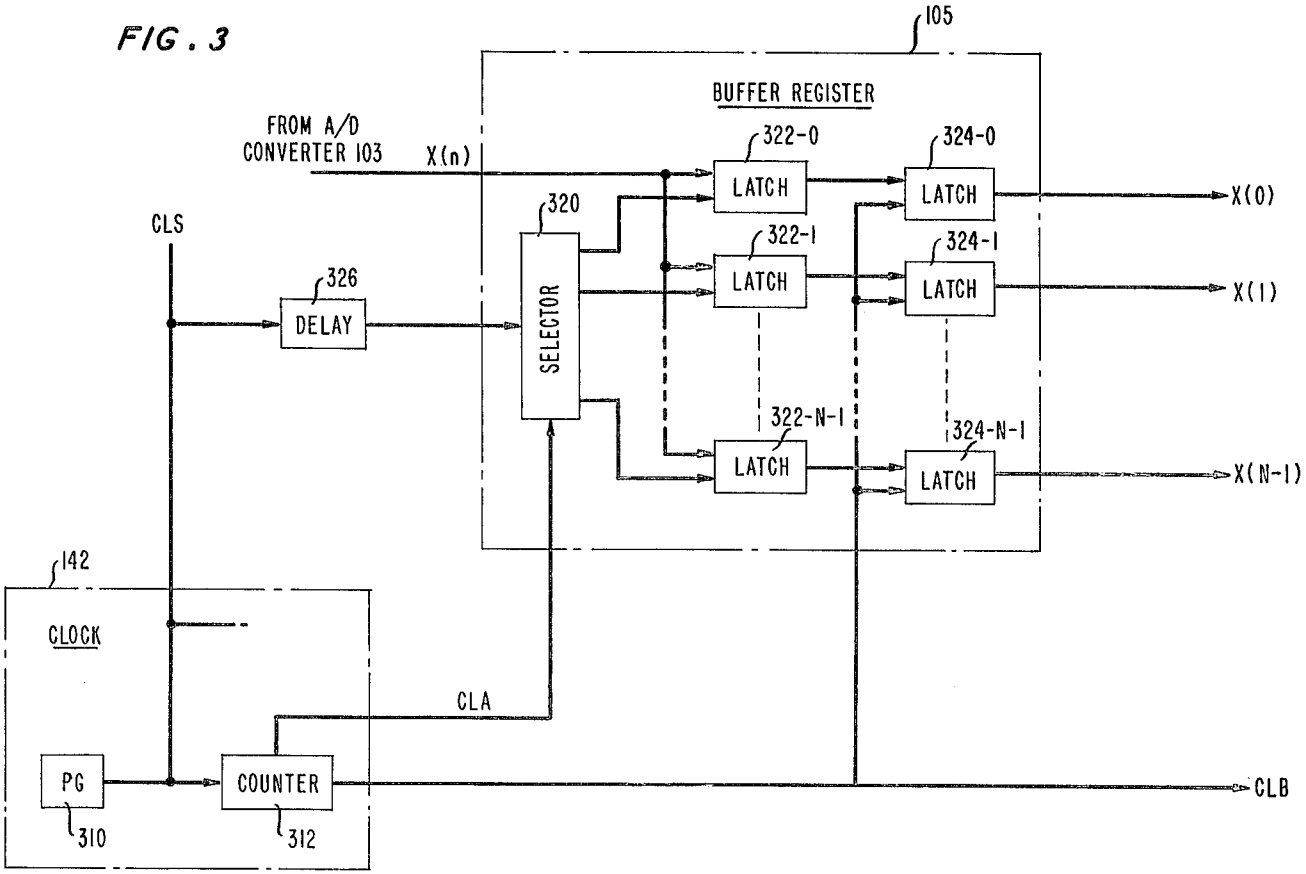
FIG. 3 depicts a detailed block diagram of a clock used in FIGS. 1 and 2 and the buffer register of FIG. 1.

Clock 142 and buffer register 105 are shown in detail in FIG. 3. Referring to FIG. 3, clock 140 includes pulse generator 310 which provides short duration CLS pulses at a predetermined rate, e.g., 1/(8 kHz). The CLS pulses are applied to counter 312 operative to generate a sequence of N, e.g., 256, CLA address codes and a CLB clock pulse at the termination of each $N^{th}$, e.g., $256^{th}$, CLS pulse. The CLA address codes are applied to the address input of selector 320 in buffer register 105. Responsive to each delayed CLS clock pulse from delay 326, selector 320 applies a pulse to the clock inputs of latches 322-0 through 322-N-1 in sequence so that the coded signals X(n) from A/D converter 103 are partitioned into blocks of N=256 codes X(0), X(1), . . . , X(N−1). Thus, the first coded speech sample signal X(0) of a block is stored in latch 322-0 responsive to the first CLS pulse of the block. The second speech sample signal X(1) is placed in latch 322-1 responsive to the second CLS signal of the block and the last speech sample signal X(N−1) is placed in latch 322-N-1 responsive to the last CLS pulse of the block.

After the last CLS pulse of the block, a CLB pulse is obtained from counter 312. The CLB pulse is operative to transfer the X(0), X(1), . . . , X(N−1) signals in latches 322-0 through 322-N-1 to latches 324-0 through 324-N-1, respectively. The block signals X(0), X(1), . . . , X(N−1) are stored in latches 324-0 through 324-N-1, respectively, during the next sequence of 256 CLS pulses while the next block signals are serially inserted into latches 322-0 through 322-N-1. In this manner, each block of coded speech sample signals is available from the outputs of buffer register 105 for 256 sample pulse times.

The X(0), X(1), . . . , X(N−1) signals from buffer register 105 are applied in parallel to discrete cosine transformation circuit 107 which is operative to transform the block speech sample codes into a set of N discrete cosine transform coefficient signals $X_{DCT}(0)$, $X_{DCT}(1)$, . . . , $X_{DCT}(N-1)$ at equispaced frequencies $\omega = k\pi/2N$ where k=0, 1, . . . , N−1. This transformation is done by forming the 2N point Fast Fourier transform of the block of speech signal samples so that Fast Fourier transform coefficients Re $X_{FFT}(0)$, Re $X_{FFT}(1)$, . . . , Re $X_{FFT}(N-1)$ and Im $X_{FFT}(0)$, Im $X_{FFT}(1)$, . . . , Im $X_{FFT}(N-1)$ are made available. Re denotes the real part and Im denotes the imaginary part of each $X_{FFT}(n)$ signal. The discrete cosine transform signal is then $$X_{DCT}(0) = \sqrt{\frac{1}{N}}\ \{Re\ X_{FFT}(0)\} \tag{1}$$

and $$X_{DCT}(k) = \sqrt{\frac{2}{N}}\ \{\cos\frac{k\pi}{2N}\ Re\ X_{FFT}(k) + \sin\frac{k\pi}{2N}\ Im\ X_{FFT}(k)\} \tag{2}$$

for k=1, 2, . . . , N−1.

Figure 4:
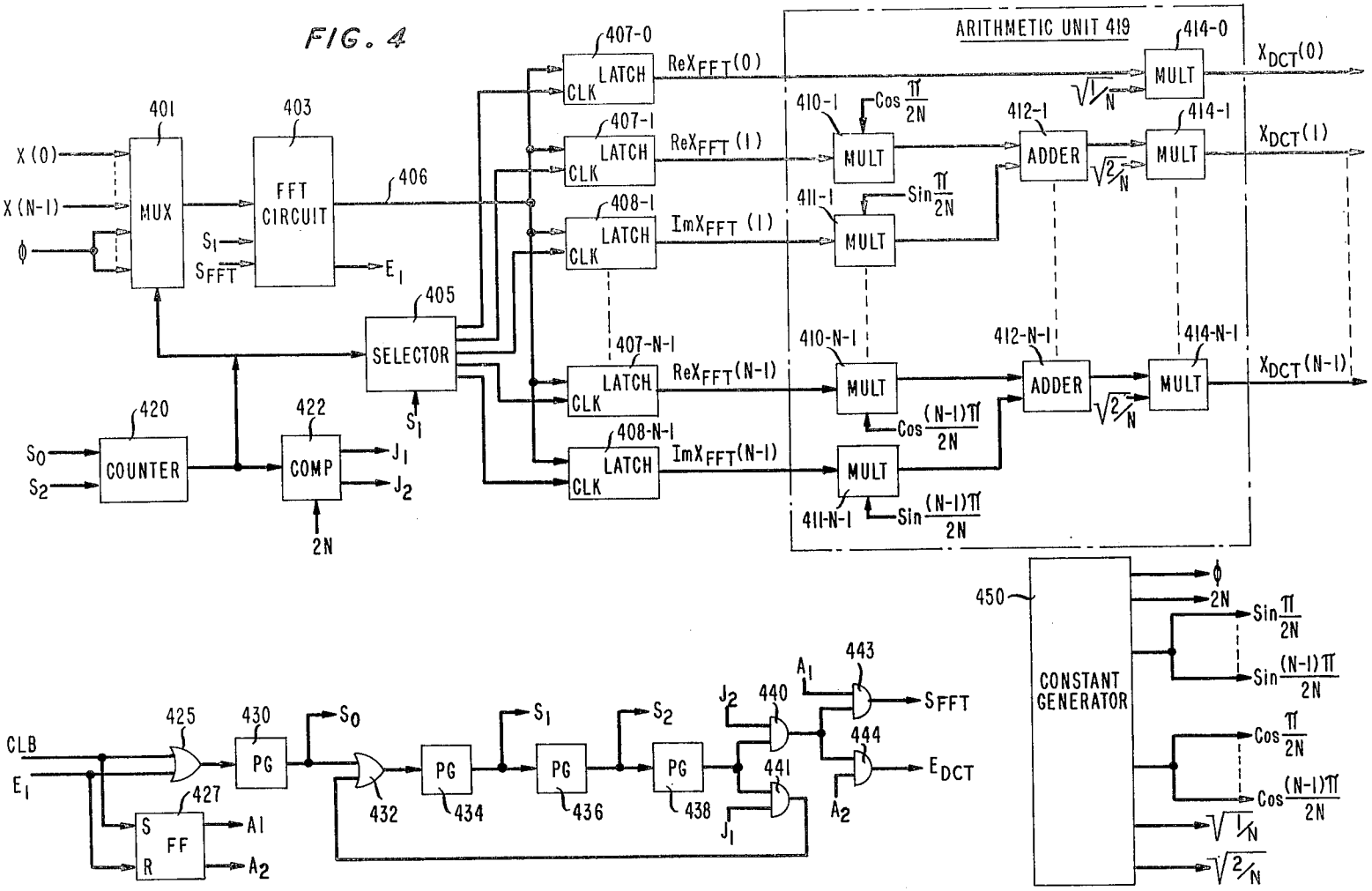
FIG. 4 depicts a detailed block diagram of a discrete cosine transform circuit useful in the circuit of FIG. 1.

Discrete cosine transformation circuit (107) is shown in greater detail in FIG. 4. Fast Fourier transform circuit 403 in FIG. 4 may, for example, comprise the circuit disclosed in U.S. Pat. No. 3,588,460 issued to Richard A. Smith on June 28, 1971 and assigned to the same assignee. In FIG. 4, multiplexor 401 receives the block speech sample signal codes X(0), X(1), . . . , X(N−1) from buffer register 105. Since FFT circuit 403 is operative to perform a 2N point analysis of the signals applied thereto, a zero code signal produced in constant generator 450 is also supplied to the remaining N inputs of multiplexor 401. Responsive to the trailing edge of the CLB clock pulse which makes signals X(0), X(1), . . . , X(N−1) available at the inputs of multiplexor 401, pulse generator 430 produces an $S_0$ control pulse which clears counter 420 to its zero state. At this time, flip-flop 427 is set so that a high $A_1$ output is obtained therefrom.

Pulse generator 434 is triggered by the trailing edge of pulse $S_0$ whereby an $S_1$ control pulse is generated. The $S_1$ pulse from generator 434 is supplied to the clock input of FFT circuit 403. Multiplexor 401 is addressed by the zero state output code from counter 420 so that the X(0) speech signal code is supplied to the input of FFT circuit 403. Responsive to the $S_1$ pulse, the X(0) signal is inserted into FFT circuit 403 wherein it is temporarily stored. Control signal $S_2$ is produced by pulse generator 436 responsive to the trailing edge of the $S_1$ pulse and counter 420 is incremented to its next state by the $S_2$ pulse. The X(1) signal is now applied to the input of FFT circuit 403 via multiplexor 401. The output of counter 420 is also applied to comparator 422 wherein it is compared to the 2N constant signal from constant generator 450. Since counter 420 is in its first state which is less than 2N, the $J_1$ output of comparator 422 is high and AND gate 441 is enabled when pulse generator 438 is triggered by the trailing edge of pulse $S_2$. In this way, another sequence of $S_1$ and $S_2$ pulses is obtained from pulse generators 434 and 436. Responsive to the $S_1$ and $S_2$ pulses, the X(1) signal is inserted into FFT circuit 403 via multiplexor 401, and counter 420 is incremented to its next state.

The sequence of $S_1$ and $S_2$ pulses is repeated until all inputs to multiplexor 401, including N zero code inputs, are inserted into FFT circuit 403. When counter 420 is incremented to its 2N+1 state, the $J_2$ output of comparator 422 becomes high and AND gate 440 is enabled by the output of pulse generator 438. Responsive to the high $A_1$ signal from flip-flop 427 and the high output of enabled gate 440, AND gate 443 provides a high $S_{FFT}$ signal which is applied to FFT circuit 403. Responsive to the high $S_{FFT}$ pulse, FFT circuit 403 produces the signals Re $X_{FFT}(0)$, Re $X_{FFT}(1)$, . . . , Re $X_{FFT}(N-1)$ and Im $X_{FFT}(0)$, Im $X_{FFT}(1)$, . . . , Im $X_{FFT}(N-1)$ and temporarily stores these signals. Upon termination of the computation, FFT circuit 403 produces an $E_1$ signal which resets flip-flop 427 and triggers pulse generator 430.

Pulse $S_0$ from generator 430 clears counter 420 to its zero state preparatory to the transfer of the Re $X_{FFT}(k)$ and Im $X_{FFT}(k)$ signals (k=0, 1, . . . , N−1) to latches 407-0 through 408-N-1. During each of the repeated sequences of control pulses $S_1$ and $S_2$, selector 405 addresses the latch designated by the state of counter 420. The $S_1$ pulse reads out the signal, e.g., Re $X_{FFT}(1)$, from FFT circuit 403 which signal is applied to line 406. The $S_1$ pulse is supplied to the clock input of the addressed latch 407-1 via selector 405 and the Re $X_{FFT}(1)$ is inserted into this latch. the succeeding $S_2$ pulse increments counter 420 whereby the next $S_1$ pulse reads out the Im $X_{FFT}(1)$ signal, which signal is inserted into latch 408-1 under control of selector 405.

Arithmetic unit 419 receives the signals from latches 407-0 through 408-N-1 and generates a set of discrete cosine transform coefficient signals, $X_{DCT}(0)$, $X_{DCT}(1)$, . . . , $X_{DCT}(N-1)$ in accordance with equations 1 and 2. For each pair of signals Re $X_{FFT}(k)$, Im $X_{FFT}(k)$, except for k=0, Re $X_{FFT}(k)$ is multiplied by a constant cos $k\pi/2N$, and Im $X_{FFT}(k)$ is multiplied by the constant sin $k\pi/2N$. For k=1, multiplier 410-1 is operative to form the signal $$\cos \pi/2N \cdot \mathrm{Re}\ (X_{FFT}(1))$$

and multiplier 411-1 is operative to form the signal sin $\pi/2N$ Im($X_{FFT}(1)$). The outputs of multipliers 410-1 and 411-1 are added together in adder 412-1, and the output of adder 412-1 is multiplied by a constant $\sqrt{2/N}$ in multiplier 414-1. The output of multiplier 414-1 is $X_{DCT}(1)$, which is the transform coefficient at frequency $\omega = \pi/2N$.

After the signal Im $X_{FFT}(N-1)$ is placed in latch 408-N-1 and the $X_{DCT}(N-1)$ signal appears at the output of multiplier 414-N-1, counter 420 is incremented to its 2N+1 state by an $S_2$ pulse. Comparator 422 produces a high $J_2$ signal and AND gate 440 is enabled by the pulse output of pulse generator 438. Since the $A_2$ output of flip-flop 427 is high at this time, AND gate 444 is also enabled so that an $E_{DCT}$ pulse (waveform 1905 of FIG. 19) is obtained therefrom at time $t_1$. The $E_{DCT}$ pulse occurs on the termination of the formation of the transform coefficient signals for the block speech sample X(0), X(1), . . . , X(N−1) in discrete cosine transformation circuit 107. A typical spectrum for the discrete cosine transform of an input speech sample block is shown in waveform 1601 in FIG. 16.

Each DCT transform coefficient signal includes a component predictable from the known parameters of speech signals and an unpredictable component. The predictable component can be estimated and transmitted at a substantially lower bit rate than the transform coefficient signals themselves. The predictable component, in accordance with the invention, is obtained by forming a prediction parameter estimate from the block DCT transform coefficients, which estimate corresponds to the formant spectrum of the block DCT transform coefficient signals and also forming a pitch excitation estimate in terms of a signal representative of the pitch period of the block and a pitch gain signal representative of the shape of the pitch excitation waveform. These formant and pitch excitation parameters provide an accurate estimate of the predictable speech characteristics in the block DCT spectrum.

The predicted component of the DCT transform coefficient signals, i.e. prediction parameters, pitch period and pitch gain signals, are encoded and transmitted separately. Consequently, the predicted component of each transform coefficient signal $X_{DCT}(k)$ may be divided out of $X_{DCT}(k)$ and the transmission rate for the unpredicted portion of $X_{DCT}(k)$ can be substantially reduced. The total bit rate required to transmit the speech signal is thereby reduced. Since the estimate of the predicted portion of the signal includes the pitch excitation information as well as the formant information of the block, a relatively high quality digital speech transmission arrangement is achieved at the low bit rate.

In the circuit of FIG. 1, the $X_{DCT}(k)$ signals of the block are applied via delay 108 to quantizer 109, in which quantizer the predicted component of each coefficient signal is removed. The predicted component is generated by means of autocorrelator 113, parcor coefficient generator 115 which produces the prediction parameters for the block, and pitch analyzer 117 which produces the pitch excitation parameter signals of the block, pitch period and pitch gain signals. The resulting predictive and pitch excitation parameter signals are encoded in encoder 120 and are multiplexed with the adaptively quantized DCT transform coefficient signals from quantizer 109 in multiplexor 112. The resulting multiplexed signals are then applied to digital communication channel 140.

Figure 5:
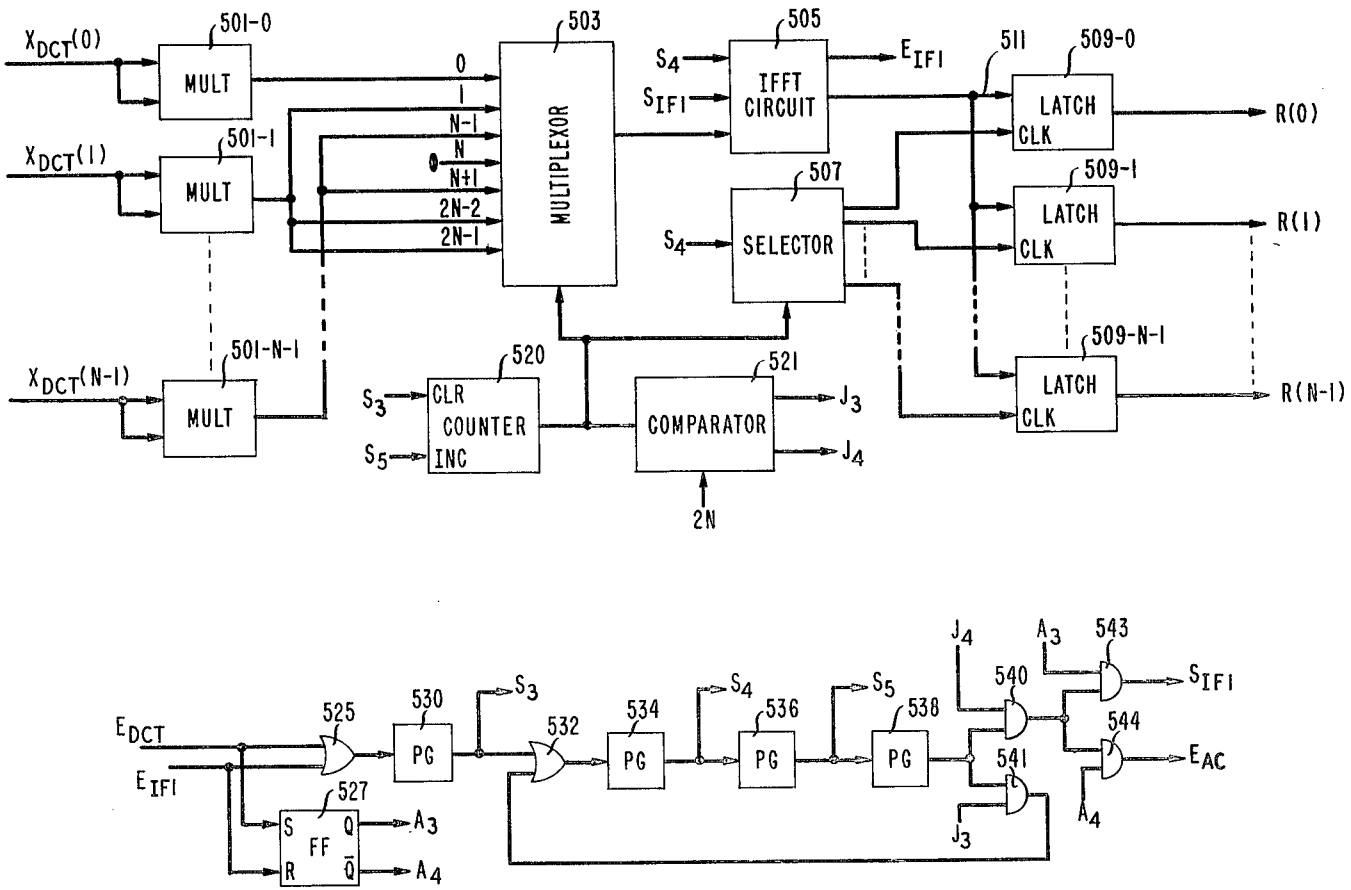
FIG. 5 depicts a detailed block diagram of an autocorrelator circuit useful in the circuit of FIG. 1.

Autocorrelator 113 which produces an autocorrelation signal responsive to the DCT coefficient signals from discrete cosine transformation circuit 107 is shown in greater detail in FIG. 5. The autocorrelator provides a set of signals $$R(n) = \frac{1}{2N} X^2_{DCT}(0) + \frac{1}{N} \sum_{k=1}^{N-1} X^2_{DCT}(k) \cos \frac{2\pi}{2N} kn \qquad (3)$$
$$n = 0, 1, \ldots, N-1$$

The circuit of FIG. 5 is operative to generate the autocorrelation signals in accordance with $$R(n) = \frac{1}{2N} \sum_{k=0}^{2N-1} U^2_{DCT}(k)\, e^{j\frac{2\pi}{2N} kn} \qquad (4)$$

where $$U_{DCT}(k) = \begin{cases} X_{DCT}(k) \text{ for } k = 0, 1, \ldots, N-1 \\ 0 \text{ for } k = N \\ X_{DCT}(2N-k) \text{ for } k = N+1, N+2, \ldots, 2N-1 \end{cases} \qquad (5)$$

In FIG. 5, each signal $X_{DCT}(0)$, $X_{DCT}(1)$, . . . , $X_{DCT}(N-1)$ of the block is multiplied by itself in multipliers 501-0 through 501-N-1, respectively. The resulting squared signals are applied in the particular order prescribed by equation 5 for a 2N point inverse Fast Fourier transformation to IFFT circuit 505 via multiplexor 503. The inverse transform signals obtained from IFFT circuit 505 in accordance with equation 4 are supplied to latches 509-0 through 509-N-1 so that the autocorrelation signals R(0), R(1), . . . , R(N−1) of the block are stored in these latches.

Responsive to the trailing edge of signal $E_{DCT}$ from discrete cosine transformation circuit 107, pulse generator 530 produces an $S_3$ control pulse which clears counter 520 to its zero state. Flip-flop 527 is also set by signal $E_{DCT}$ so that a high $A_3$ signal is obtained therefrom. The zero state output of counter 520 is applied to multiplexor 503 and the multiplexor is operative to transfer the $X^2DCT(0)$ signal from multiplier 501-0 to IFFT circuit 505. Pulse generator 534 is triggered by the trailing edge of pulse $S_3$ and the $S_4$ control pulse therefrom is operative to temporarily store the $X^2DCT(0)$ signal in IFFT circuit 505.

The $S_5$ control pulse, produced by pulse generator 536 at the trailing edge of pulse $S_4$, increments counter 520 to its first state. The state of counter 520 is compared to the constant 2N in comparator 521. Since the state of counter 520 is less than 2N, a high $J_3$ signal is generated and AND gate 541 is enabled when a pulse is obtained from pulse generator 538. Responsive to the high output of enabled gate 541, a sequence of $S_4$ and $S_5$ pulses is generated. This sequence causes the output of multiplier 501-1 to be placed in IFFT circuit 505 and increments counter 520 to its next state.

After the $X_{DCT}^2(N-1)$ signal is placed in IFFT circuit 505, a constant $\phi$ signal is inserted therein responsive to the next $S_4$ and $S_5$ pulse sequence according to equation 5. Since multiplier 501-N-1 is also connected to the N+1 input of multiplexor 503, the $X_{DCT}^2(N-1)$ signal from multiplier 501-N-1 is the next signal inserted in IFFT circuit 505, which circuit requires 2N inputs.

In response to the next N-2 pairs of $S_4$ and $S_5$ pulses, the outputs of multipliers 501-N-2 through 501-0 are put into IFFT circuit 503 in reverse order according to equation 5. When counter 520 is in its $2N^{th}$ state, the $X^2_{DCT}(1)$ signal is inserted into IFFT circuit 505 in accordance with equation 5 during an $S_4$ pulse. The next $S_5$ pulse increments counter 520 ot its $2N+1^{th}$ state and comparator 521 provides a high $J_4$ signal. AND gate 540 is then enabled by the pulse output of pulse generator 538. Responsive to the high $A_3$ signal from flip-flop 527 and the output of enabled gate 540, a high $S_{IF1}$ signal appears at the output of AND gate 543. The $S_{IF1}$ signal is applied to IFFT circuit 505 to initiate the generation of the R(n) signals in accordance with equation 4.

After the R(N−1) signal has been formed in IFFT circuit 505, an $E_{IF1}$ signal is produced by the IFFT circuit. The $E_{IF1}$ signal resets flip-flop 527 so that a high $A_4$ signal is obtained. Signal $E_{IF1}$ also triggers pulse generator 530. The $S_3$ control pulse obtained from pulse generator 530 causes counter 520 to be cleared to its zero state. The zero state output of counter 520 addresses line 511 which is then operative to enable latch 509-0. The trailing edge of the $S_3$ pulse triggers pulse generator 534 and the $S_4$ control pulse from generator 534 causes the R(0) signal from IFFT circuit 505 to be inserted into latch 509-0 via line 511. The $S_5$ pulse produced by pulse generator 536 responsive to the trailing edge of pulse $S_4$ increments counter 520 to its next state. The $J_3$ output of comparator 521 is high whereby AND gate 541 is enabled when pulse generator 538 is triggered. In this manner, the sequence of $S_4$ and $S_5$ pulses is repeated until counter 520 is incremented to its 2N+1 state.

Figure 19:
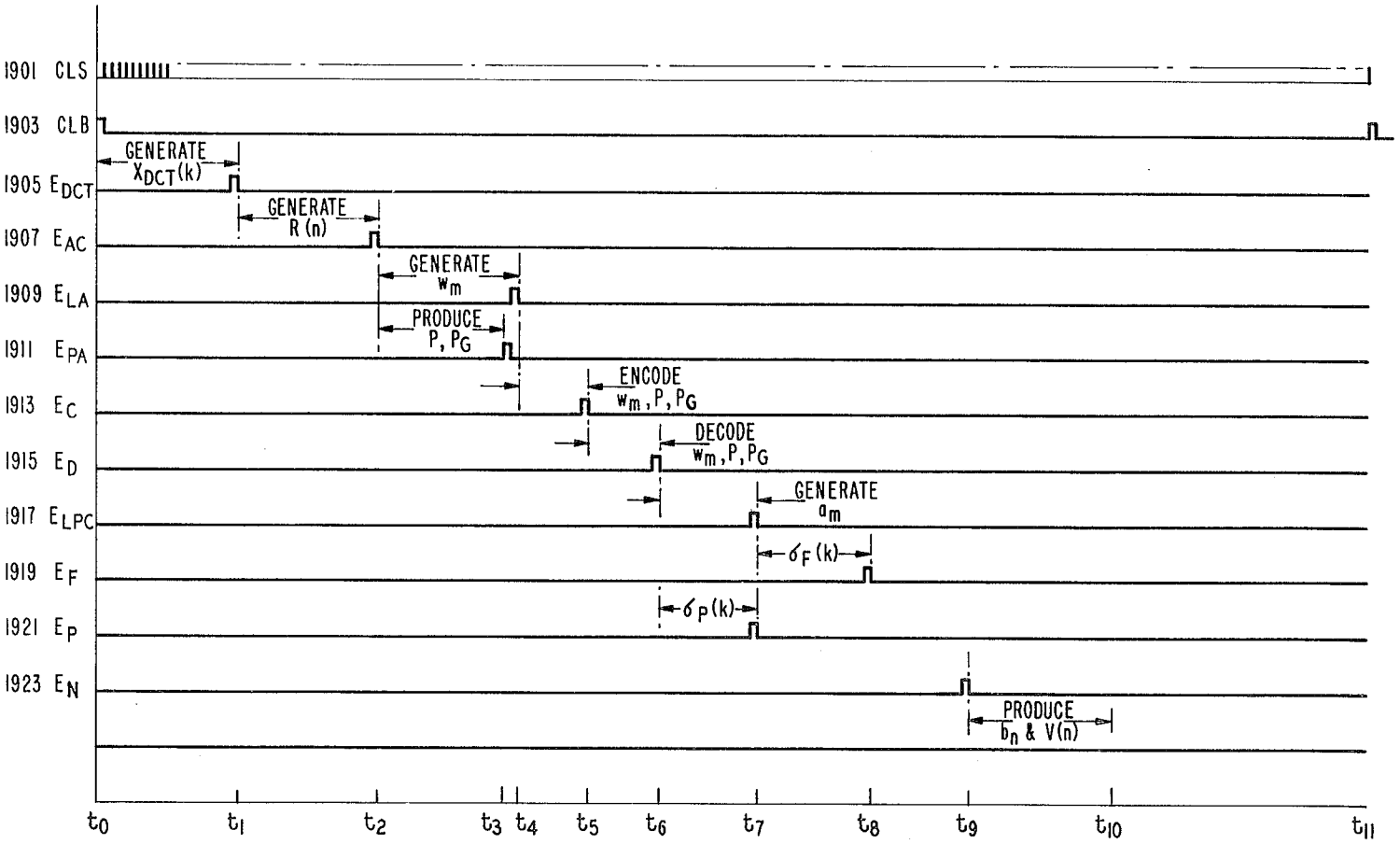

The sequence of R(0), R(1), . . . , R(N−1) signals is inserted into latches 509-0 to 509-N-1 by the repeated $S_4$ and $S_5$ pulse sequence. After a high $J_4$ signal is obtained from comparator 521 responsive to the $2N+1^{th}$ $S_5$ pulse, AND gate 540 is enabled and an $E_{AC}$ pulse (waveform 1907 of FIG. 19 is obtained from AND gate 544 at time $t_2$. The $E_{AC}$ pulse indicates that the autocorrelation signals R(0), R(1), . . . , R(N−1) are stored so that the prediction parameters for the block and the pitch and pitch gain signals of the block may be produced in parameter computer 115 and pitch analyzer 117 of FIG. 1.

Parameter computer 115 is operative to produce a set of p parcor coefficients $w_0, w_1, \ldots, w_p$ for each block of speech samples from the first p (less than N−1) autocorrelation signals. p, for example, may be equal to 12. The parcor coefficients represent the predictable portion of the discrete cosine transform coefficient signals related to the formants of the block speech segment. The $w_m$ parcor parameters are obtained in accordance with $$w_m = -[R(m) + \sum_{j=1}^{m-1} a_j^{(m-1)} R_{m-j}]/E_{m-1} \quad (6)$$

where $E_0 = R(0)$ $$a_m^{(m)} = w_m,$$

$$a_j^{(m)} = a_j^{m-1} + w_m a_{m-j}^{m-1} \; 1 \leqq j \leqq m-1 \quad (7)$$

and $E_m = (1 - w_m)^2 E_{m-1}$

Figure 13:
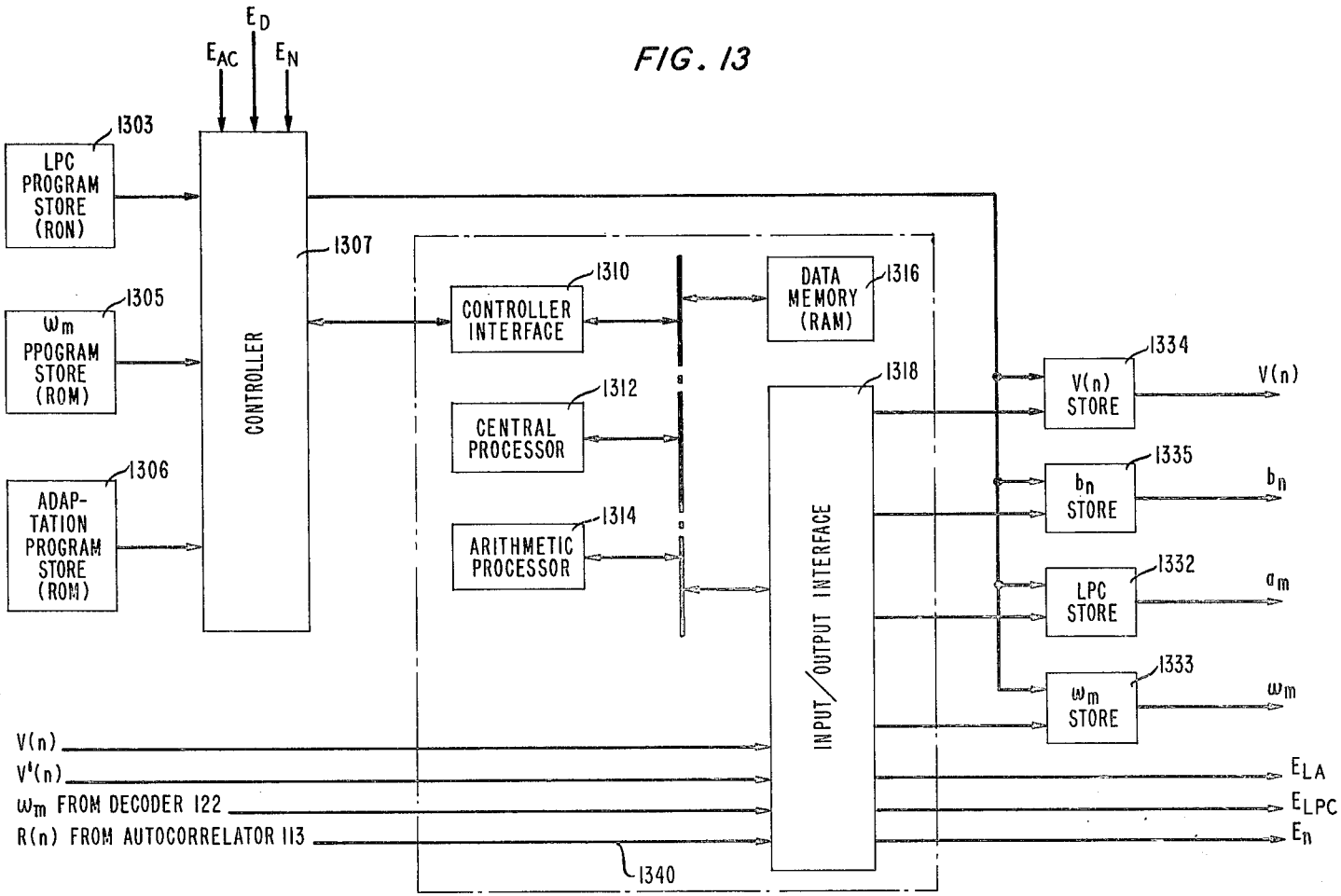
FIG. 13 shows a block diagram of a digital processor arrangement useful in the circuit of FIGS. 1 and 2.

Parameter computer 115 may comprise the processing arrangement of FIG. 13 in which processor 1309 is operative to perform the computation required by equation 6 in accordance with program instructions stored in read only memory 1305. The stored instructions for the generation of the parcor coefficients $w_m$ in ROM 1305 are listed in Fortran language in appendex A. Processor 1309 may be the CSP, Inc. Macro Arithmetic Processor system 100 or may comprise other processor arrangements well known in the art. Controller 1307 causes $w_m$ program store 1305 to be connected to processor 1309 upon the occurrence of the $E_{AC}$ signal in autocorrelator 113. In accordance with the permanently stored instructions in program store 1305, the first p autocorrelation signals in latches 509-0 through 509-P of FIG. 5 are placed in random access data memory 1316 via line 1340 and input/output interface 1318. The $w_0, w_1, \ldots, w_p$ parcor coefficient signals are then generated in central processor 1312 and arithmetic processor 1314. The $w_m$ outputs are placed in data memory 1316 and are transferred therefrom to $w_m$ store 1333 via input/output interface 1318. Processor 1309 also produces an $E_{LA}$ signal (waveform 1909 of FIG. 19) at time $t_4$ when the $w_m$ signals are available in store 1333.

The pitch excitation coefficient signals are produced in pitch analyzer 117 responsive to the R(0), R(1), . . . , R(N−1) autocorrelation signals from autocorrelator 113. Two pitch excitation parameter signals are generated. The first signal is representative of the ratio of the maximum autocorrelation signal $R_{max}$ to the initial autocorrelation signal R(0) and the second signal P corresponds to the time of occurrence of the $R_{max}$ signal. The ratio $P_G = R_{max}/R(0)$ (pitch gain) and the signal P (pitch period) are then utilized to construct an impulse train signal representative of the pitch excitation.

Figure 6:
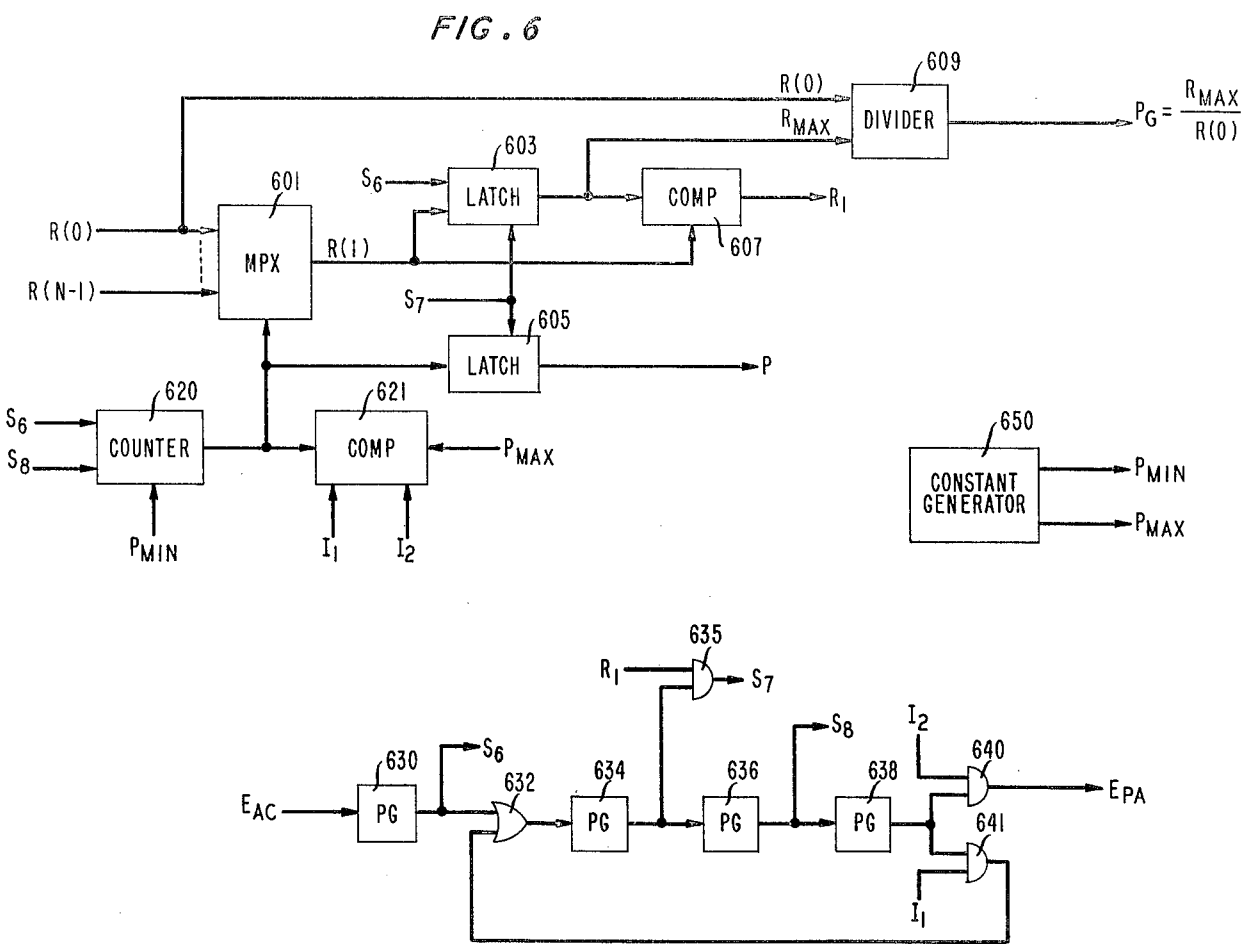
FIG. 6 depicts a detailed block diagram of a pitch analyzer circuit useful in the circuit of FIG. 1.

Pitch analyzer 117 is shown in greater detail in FIG. 6. Referring to FIG. 6, multiplexor 601 sequentially applies the R(0), R(1), . . . , R(N−1) signals from autocorrelator 113 to comparator 607 under control of counter 620. Comparator 607 determines whether the incoming R(n) signal is greater than the preceding signal stored in latch 603 so that the maximum autocorrelation signal is stored in latch 603, and the corresponding correlation signal index is stored in latch 605. The ratio $P_G = R_{max}/R(0)$ is formed in divider 609.

Responsive to the $E_{AC}$ signal from autocorrelator 113, pulse generator 630 produces an $S_6$ control signal which allows a constant $P_{min}$ from constant generator 650 to be inserted into counter 620. $P_{min}$ corresponds to the shortest pitch period expected at the speech signal sampling rate, e.g., 20 samples, at a sampling rate of 8 kHz. The output of counter 620 is applied to the address input of multiplexor 601 so that the corresponding correlation signal is supplied to comparator 607 and to the input of latch 603. Pulse $S_6$ also clears latch 603 to zero so that the output of multiplexor 601 is compared to the zero signal stored in latch 603. If the signal from multiplexor 601 is greater than zero, the $R_1$ output of comparator 607 becomes high. When a pulse is produced by pulse generator 634 responsive to the trailing edge of pulse $S_6$, AND gate 635 produces an $S_7$ signal which inserts the multiplexor output into latch 603. The state of counter 620 is also inserted into latch 605 by the $S_7$ pulse. Upon termination of the pulse from pulse generator 634, an $S_8$ control pulse is produced by pulse generator 636. The $S_8$ pulse increments counter 620 to its next state so that the next autocorrelation signal is obtained from the output of multiplexor 601.

Comparator 621 is operative to compare the state of counter 620 to a constant $P_{max}$ obtained from constant generator 650. The $P_{max}$ signal code corresponds to the largest pitch period expected at the speech signal sampling rate, e.g., 100 samples at a sampling rate of 8 kHz. Until the output of counter 620 exceeds $P_{max}$, the $I_1$ output of comparator 621 is high and AND gate 641 is enabled by the output of pulse generator 638. Responsive to a high output of AND gate 641, pulse generators 634, 636, and 638 are triggered in sequence. In this manner, the content of latch 603 corresponding to the maximum found autocorrelation signal is compared to the next successive autocorrelation signal from multiplexor 601. The greater of the two autocorrelation signals is stored in latch 603 and the corresponding index is placed in latch 605. After the $I_2$ signal from comparator 621 becomes high, the maximum value autocorrelation signal $R_{max}$ is in latch 603 and the corresponding index P is in latch 605. The output of divider 609 provides signal $P_G = R_{max}/R(0)$. The high $I_2$ signal is supplied to AND gate 640 so that this gate produces an $E_{PA}$ pulse (waveform 1911 of FIG. 19) at time $t_3$ when pulse generator 638 produces a pulse responsive to an $S_8$ pulse.

After both the $E_{LA}$ and the $E_{PA}$ signals occur, encoder 120 in FIG. 1 is enabled. The $w_1, w_2, \ldots, w_p$ signals from parameter computer 115 and the $P_G$, and P signals from pitch analyzer 117 are encoded in encoder 120 preparatory to transmission over communication channel 140 via multiplexor 112. The encoded signals from the output of encoder 120 are also supplied to decoder 122 which is operative to decode the encoded $w_m$, $P_G$ and P signals responsive to signal $E_C$ (waveform 1913 of FIG. 19) from encoder 120. When these signals are decoded, decoder 122 supplies an $E_D$ signal (waveform 1915 of FIG. 19) at time $t_6$ which activates LPC generator 124 and pitch excitation spectral level generator 128. LPC generator 124 is responsive to the decoded $w_m'$ signals from decoder 122 to convert said $w_m'$ signal into linear prediction coefficients $a_m$. The $a_m$ signals are supplied to formant spectral level generator 126 which is operative to produce a spectral level signal $\sigma_F(k)$ for each discrete cosine transform coefficient frequency from the block $a_m$ signals.

The processing arrangement of FIG. 13 may also be used to convert the decoded $w_m'$ signals into linear prediction coefficient signals $a_m$. Referring to FIG. 13, the $E_D$ signal from decoder 122 causes controller 1307 to connect LPC program store 1303 to processor 1309. Store 1303 is a read only memory which permanently stores a set of instruction codes adapted to transform the decoded $w_m'$ signals into linear prediction signals $a_m$ in accordance with equations 6 and 7. The instruction code set in store 1303 is listed in Fortran language in appendix B. Responsive to signal $E_D$, the instruction codes from store 1303 are transferred to central processor 1312 via control interface 1310 and cause the decoded $w_m'$ signals from decoder 122 to be inserted into data memory 1316 via input/output interface 1318. The $a_m$ signals are then produced in central processor 1312 and arithmetic processor 1314. The resulting $a_m$ signals are placed in data memory 1316 and are transferred therefrom to LPC store 1332 via input/output interface 1318. When all $a_m$ signals have been transferred to store 1332, an $E_{LPC}$ signal (waveform 1917 of FIG. 19) is produced by central processor 1312 which signal is applied to formant spectral level generator 126 via input/output interface 1318 at time $t_7$.

Figure 16:
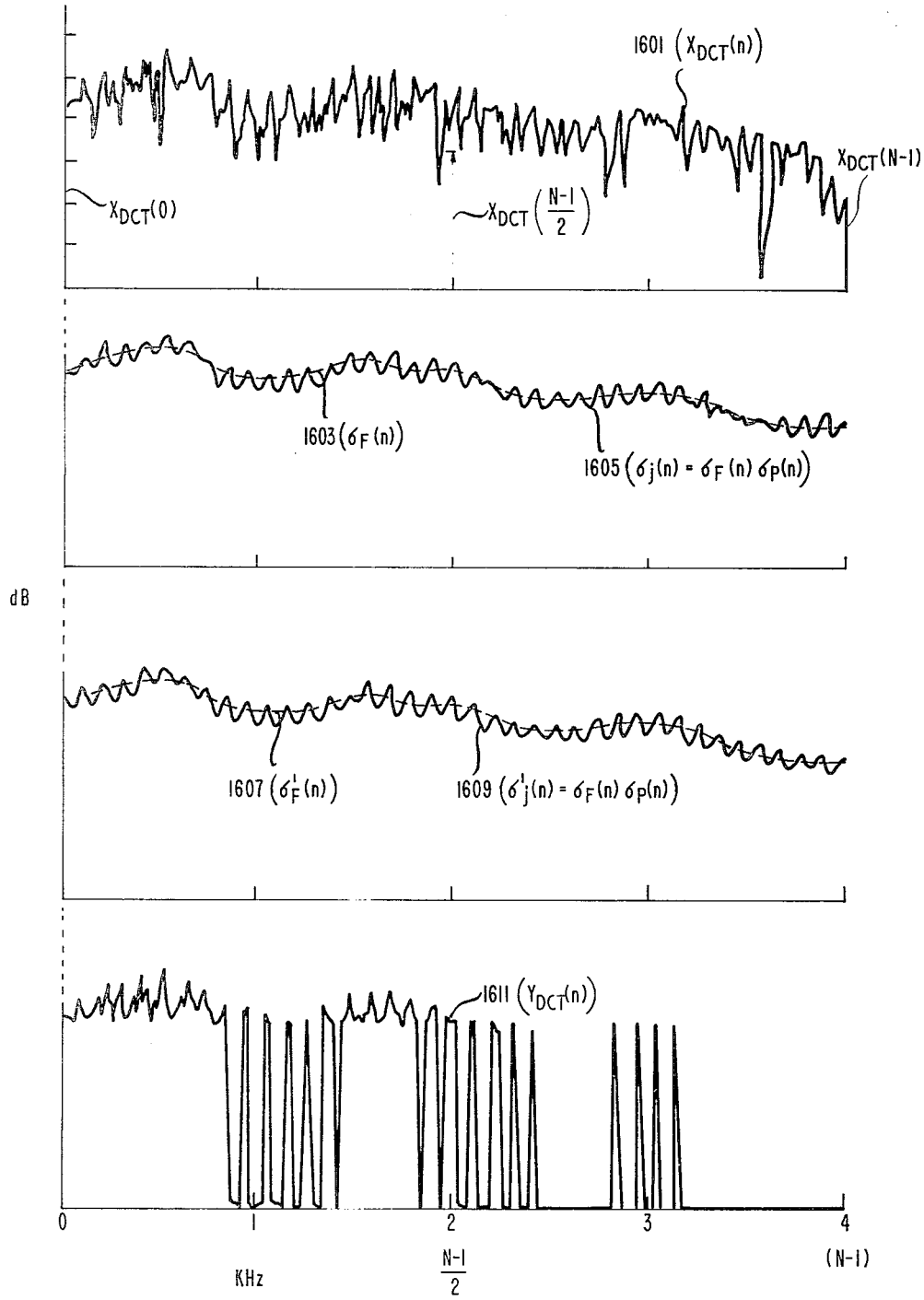

The LPC signals $a_m$ from generator 124, while representative of the predicted component of the block speech signal, must be transformed to the frequency domain in order to minimize the transmission rate of the discrete cosine transform coefficient signals from delay 108. This transformation is carried out in formant spectral level generator 126 which provides a series of formant predicted spectral level signals $\sigma_F(0), \sigma_F(1), \ldots, \sigma_F(N-1)$ responsive to the block linear prediction coefficients from generator 124. A formant spectral level signal is produced for each discrete cosine transform coefficient frequency. Waveform 1603 in FIG. 16 illustrates the formant spectrum obtained from the discrete cosine transform spectrum shown in waveform 1601. Formant spectral level generator 126 is shown in greater detail in FIG. 9, which circuit is adapted to provide a set of spectral levels $$\sigma_F(k) = \left| \frac{1}{1 + \sum_{m=1}^{P} a_m e^{-j\frac{2\pi}{2N}mk}} \right| \text{ for } k = 0, 1, \ldots, N-1 \tag{8}$$

representative of the formant predicted values of the discrete cosine transform coefficients $X_{DCT}(0), X_{DCT}(1), \ldots, X_{DCT}(N-1)$.

Figure 9:
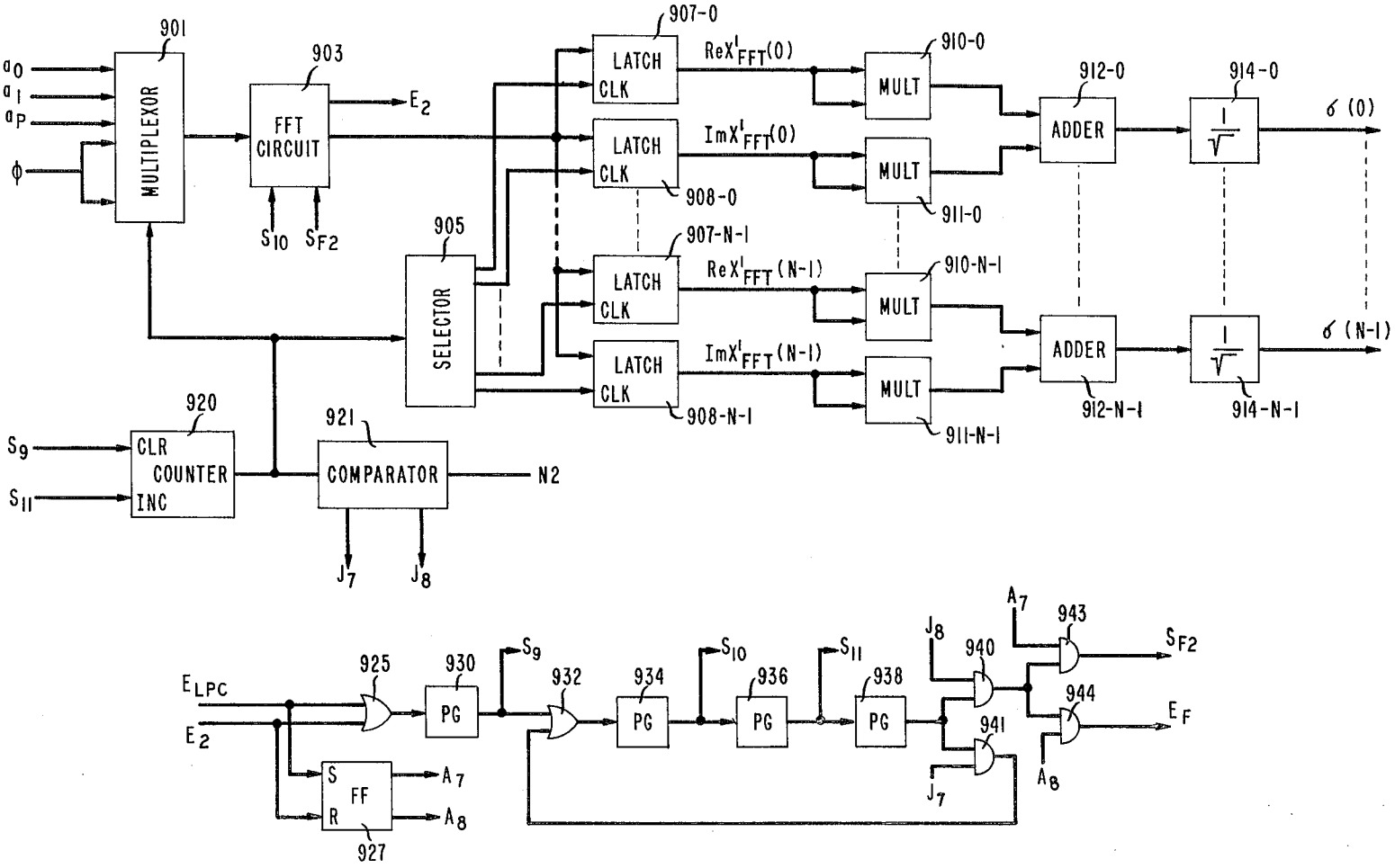
FIG. 9 shows a detailed block diagram of the formant spectral level generator used in the circuits of FIGS. 1 and 2.

In FIG. 9., the LPC signal $a_0, a_1, \ldots, a_p$ are applied to multiplexor 901 from LPC generator 124. The $E_{LPC}$ signal from generator 124 triggers pulse generator 930 to produce an $S_9$ control signal and also sets flip-flop 927 so that a high $A_7$ signal is obtained. Pulse $S_9$ clears counter 920 to its zero state. The zero state output of counter 920 is applied to multiplexor 901 so that the $a_0$ signal appears at the input of FFT circuit 903. The $S_{10}$ control pulse produced by pulse generator 934 at the trailing edge of pulse $S_9$ inserts the $a_0$ signal into FFT circuit 903. Pulse $S_{10}$ also triggers pulse generator 936 so that an $S_{11}$ control pulse is generated.

The $S_{11}$ pulse increments counter 920 and the next $a_m$ signal is supplied to FFT circuit 903 via multiplexor 901. Comparator 921 which compares the state of counter 920 to a 2N code provides a high $J_7$ signal since the state of counter 920 is less then 2N. AND gate 941 is enabled by the high $J_7$ signal and the pulse from pulse generator 938 so that another sequence of $S_{10}$ and $S_{11}$ pulses is produced.

The sequence of $S_{10}$ and $S_{11}$ pulses are repeated and the $a_0$ through $a_p$ linear prediction coefficient signals are sequentially inserted into FFT circuit 903. Since a 2N point analysis is made in the FFT circuit to produce the spectral level sequence $\sigma_F(0), \sigma_F(1), \ldots, \sigma_F(N-1)$, 2N inputs to the FFT circuit are required. After the $a_p$ signal is inserted into FFT circuit 903, a series of zero signals is inserted until counter 920 is incremented to its 2N+1 state. At this time, comparator 921 provides a high $J_8$ output. Responsive to the high $J_8$ output and the pulse from pulse generator 938, AND gate 940 is enabled. Since a high $A_7$ signal is applied to one input of AND gate 943, gate 943 is enabled to generate an $S_{F2}$ signal. The $S_{F2}$ signal initiates the FFT operation in circuit 903 so that a series of signals, Re $X'_{FFT}(0)$, Im $X'_{FFT}(0)$, Re $X'_{FFT}(1)$, Im $X'_{FFT}(1)$ . . . , Re $X'_{FFT}(N-1)$, Im $X'_{FFT}(N-1)$ is produced.

Upon completion of the FFT circuit operation, an $E_2$ pulse is produced by FFT circuit 903, which $E_2$ pulse resets flip-flop 927 and triggers pulse generator 930. The $S_9$ signal from pulse generator 930 clears counter 920 to its zero state, whereby selector 905 is connected to latch 907-0. Responsive to the $S_{10}$ pulse produced by pulse generator 934 at the trailing edge of pulse $S_9$, latch 907-0 is enabled so that the first output of FFT circuit 903, i.e., Re $X'_{FFT}(0)$ is inserted into the latch. Pulse $S_{11}$ from pulse generator 936 then increments counter 920 and the sequence of $S_{10}$ and $S_{11}$ pulses is repeated since comparator 921 provides a high $J_7$ signal. The next $S_{10}$ pulse permits the Im $X'_{FFT}(0)$ signal from FFT circuit 903 to be inserted into latch 908-0. The sequence of $S_{10}$ and $S_{11}$ pulses is repeated until counter 920 reaches its 2N+1 state, at which time latch 908-N−1 receives the Im $X'_{FFT}(N-1)$ signal.

The output of each latch in FIG. 9 is applied to a multiplexer which is operative to square the signal applied thereto, e.g., the Re $X'_{FFT}(0)$ signal is applied to both inputs of multiplier 910-0 so that $[\text{Re } X'_{FFT}(0)]^2$ is applied to adder 912-0. Adder 912-0 is operative to form the sum $$[\text{Re } X'_{FFT}(0)]^2 + [\text{Im } X'_{FFT}(0)]^2$$

and arithmetic circuit 914-0 provides the reciprocal of the square root of the signal from adder 912-0. In this manner, the $\sigma_F(0)$ signal is produced. In similar manner, the signals $\sigma_F(1), \sigma_F(2), \ldots, \sigma_F(N-1)$ are generated. The $J_8$ output of comparator 921 becomes high when counter 920 is incremented to its 2N+1 state. Responsive to the high $A_8$ signal from flip-flop 927 and the high $J_8$ signal applied to AND gate 940, the pulse from pulse generator 938 causes AND gate 944 to produce an $E_F$ signal (waveform 1919 of FIG. 19) at time $t_8$. The $E_F$ signal indicates that the $\sigma_F(0), \sigma_F(1), \ldots, \sigma_p(N-1)$ signals are available.

Figure 18:
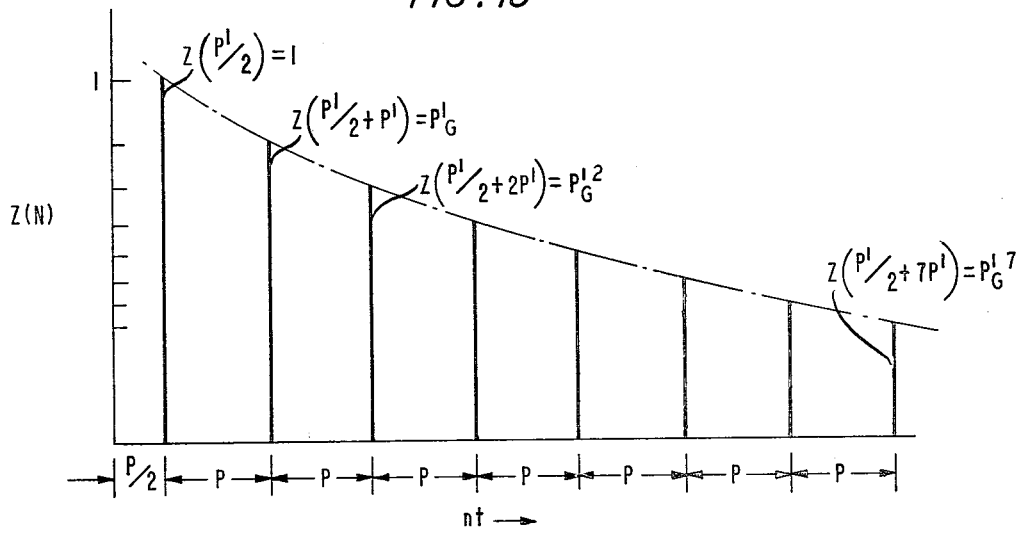
FIGS. 16, 17, 18, and 19 show waveforms useful in illustrating the operation of the circuits of FIGS. 1 and 2.

Pitch excitation spectral level generator 128 receives the decoded P' and $P'_G$ signals from decoder 122 and produces an impulse train signal responsive thereto. The impulse train is $$Z(n)=(P_G')^k \tag{9}$$

for $n=kP+P/2$ where $k=0, 1, \ldots, (N-1-P/2/P)$ and k such that $n<N-1 \cdot Z(n)=0$ for all other values of n. The impulse train signal is illustrated in FIG. 18. The Z(n) impulse train is then converted into a series of pitch excitation level signals $\sigma_p(k)$ in accordance with $$\sigma_p(k) = \left| \sum_{n=0}^{N-1} Z(n) e^{-j\frac{2\pi}{2N}nk} \right| \tag{10}$$

where $k=0, 1, \ldots, N-1$. In this way, a pitch excitation spectral level signal is obtained at each discrete cosine transform coefficient signal frequency. The $\sigma_p(k)$ signals represent the pitch excitation spectral levels at the DCT coefficient frequencies for the block. These spectral levels $\sigma_p(k)$ are predictable from P' and $P_G'$, and may be removed from the DCT coefficients to reduce the transmission rate thereof. In accordance with the invention, the formant spectral levels $\sigma_F(k)$ are modified by the pitch excitation spectral levels $\sigma_p(k)$ to form adaptation signals, which adaptation signals are used to reduce the redundancy in the DCT coefficient signals for the block.

Figure 7:
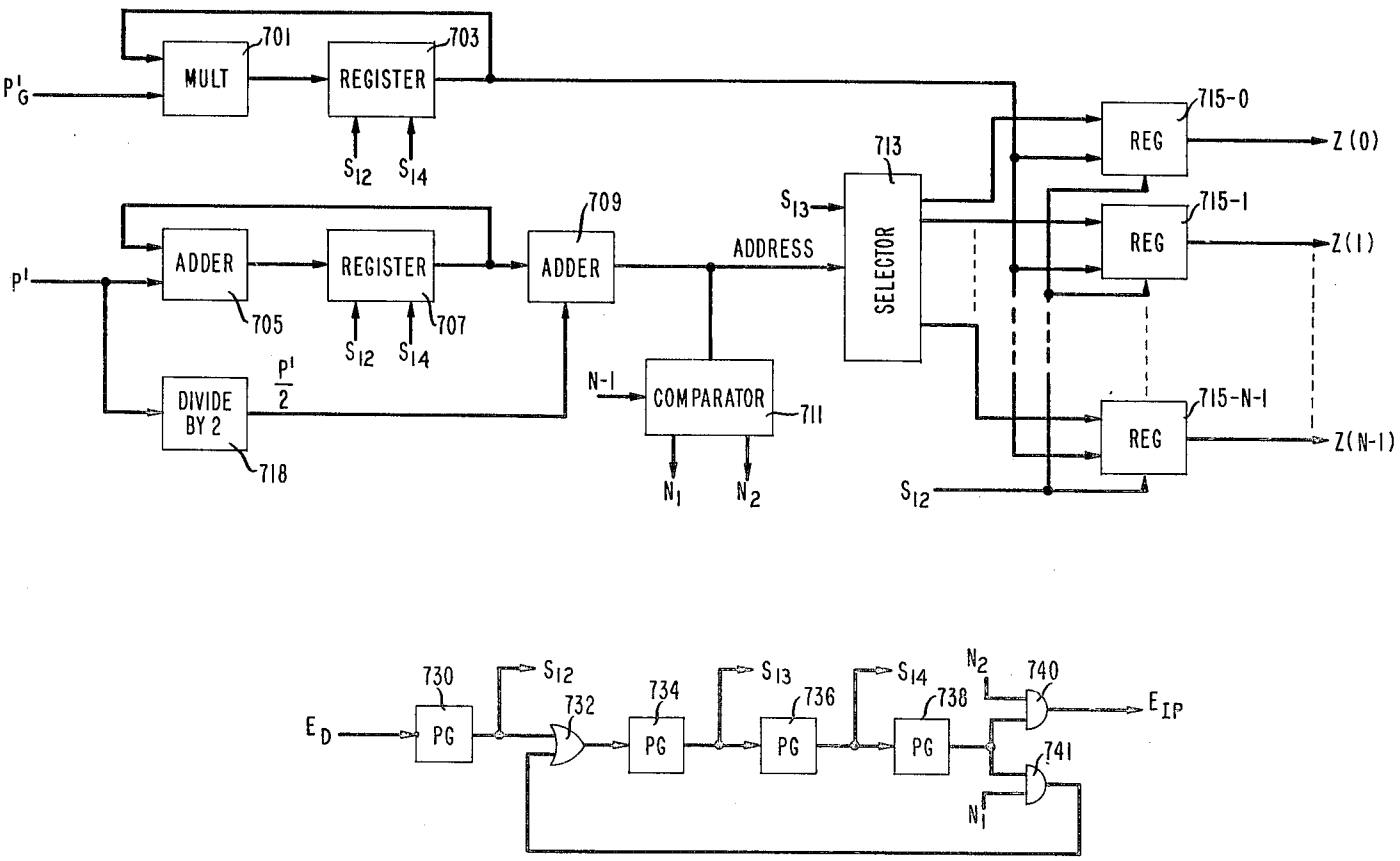
FIGS. 7 and 8 show a detailed block diagram of the pitch spectral level generator used on the circuits of FIGS. 1 and 2.
Figure 8:
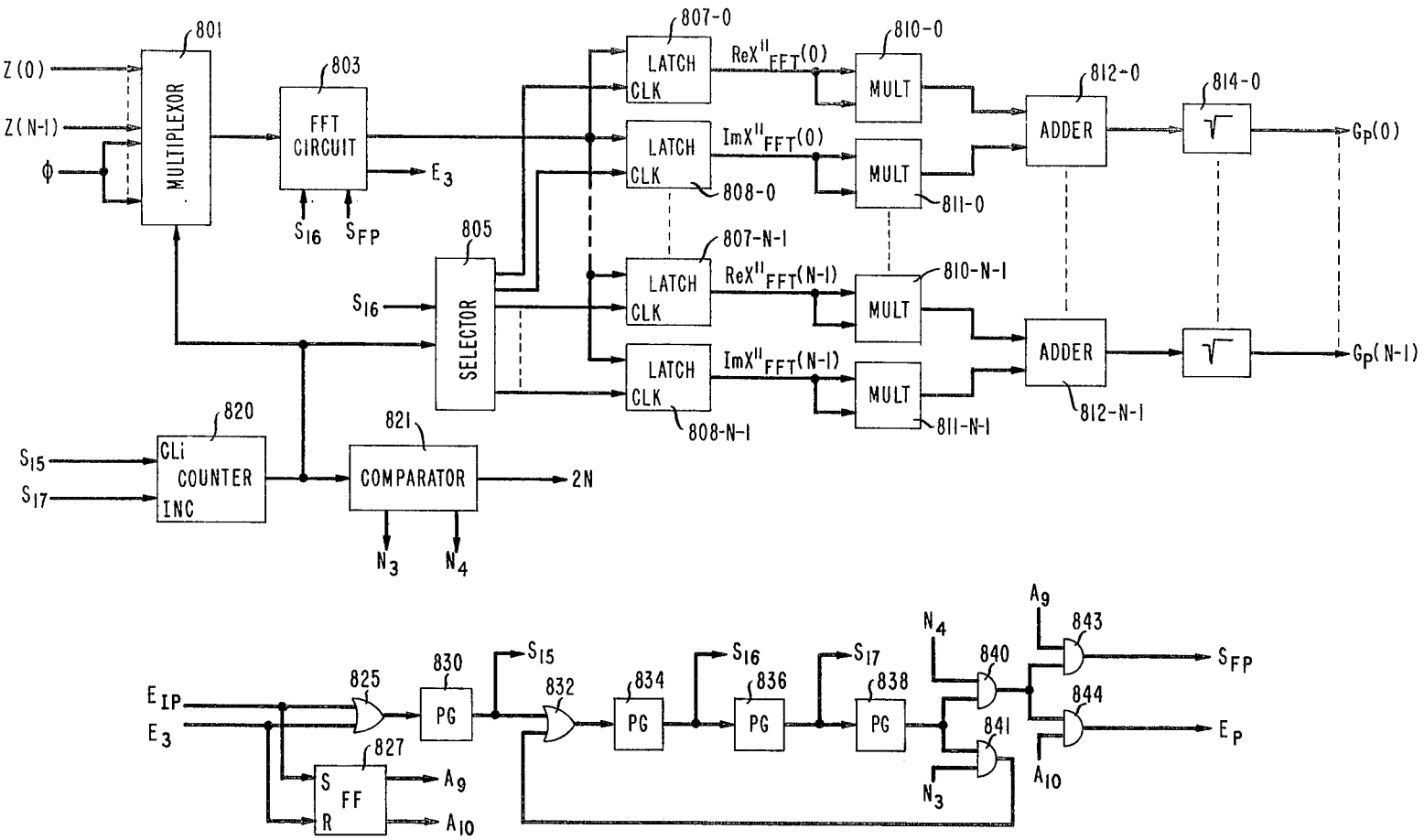

Pitch excitation level generator 128 is shown in greater detail in FIGS. 7 and 8. Referring to FIG. 7 which shows apparatus for the generation of the impulse train signal Z(n), pulse generator 730 is triggered by signal $E_D$ from decoder 122 (waveform 1915 of FIG. 19 at time $t_6$) after signals P' and $P_G'$ are available. Control pulse $S_{12}$ from generator 730 is operative to initially insert a 1 signal into register 703 and to clear registers 707 and 715-0 through 715-N−1 to zero. Divide-by-2 circuit 718 provides a P'/2 signal which appears at the output of adder 709. When control pulse $S_{13}$ is produced by pulse generator 734, selector 713 enables the register of register 715-1 through 715-N−1 which corresponds to the P'/2 address code from adder 709, register 715-P'/2. In this way, the 1 signal from register 703 is inserted into register 715-P'/2 to provide the first impulse Z(P'/2) shown in FIG. 18.

Control pulse $S_{14}$ is produced by pulse generator 736 upon the termination of pulse $S_{13}$. Responsive to pulse $S_{14}$, the output of adder 705, P', is inserted into register 707 and the output of multiplier 701, $P_G'$, is inserted into register 703. Adder 709 produces a P'/2+P' signal which is compared to an N−1 code in comparator 711. As long as the output of adder 709 is less than or equal to N−1, a high $N_1$ signal from comparator 711 enables AND gate 741 so that the $S_{13}$ and $S_{14}$ pulse sequence is repeated. Responsive to the next $S_{13}$ pulse from generator 734, the output of register 703, $P_G$, is inserted into register 715−P'/2+P' as addressed by the output of adder 709. Thus, an impulse of amplitude $P_G'$ is stored at P'/2+P' as Z(P'/2+P')=$P_G'$ shown in FIG. 18. The succeeding $S_{14}$ pulse increments register 703 to $P'_G{}^2$ and register 707 to P'/2+2P'.

The next sequence of $S_{13}$ and $S_{14}$ pulses is effective to place signal $P'_G{}^2$ into register 715-P'2+2P' and to increment registers 703 and 707 to $P'_G{}^3$ and P'/2+3P', respectively. The sequences of $S_{13}$ and $S_{14}$ pulses continue so that the impulse function of equation 9 is stored in registers 715-0 through 715-N−1. When the output of adder 709 exceeds N−1, a high $N_2$ signal is obtained from comparator 738. Responsive to the pulse from pulse generator 738 and the high $N_2$ signal, AND gate 740 produces an $E_{IP}$ pulse. The $E_{IP}$ pulse signals the completion of the Z(n) impulse train formation.

The $E_{IP}$ pulse from AND gate 740 is applied to the circuit of FIG. 8 which is adapted to form the pitch excitation spectral value signals $\sigma_p(0)$, $\sigma_p(1)$, . . . , $\sigma_p(N-1)$ from the Z(n) impulse train signal. Responsive to the $E_{IP}$ pulse, pulse generator 830 produces an $S_{15}$ control pulse which causes counter 820 to be cleared to its zero state. The zero state code from counter 830 addresses multiplexor 801 so that the Z(0) signal from the circuit of FIG. 7 is applied to the input of 2N point FFT circuit 803. Pulse generator 834 is triggered by the $S_{15}$ pulse, and the $S_{16}$ pulse therefrom permits the Z(0) signal to be inserted into FFT circuit 803. The $S_{17}$ pulse from pulse generator 838 then increments counter 820 so that the Z(1) signal is applied to FFT circuit 803 via multiplexer 801.

The output of counter 820 is compared to a 2N code in comparator 821 and, until counter 820 is incremented to its 2N+1 state, a high $N_3$ signal is obtained therefrom. AND gate 841 is enabled by the pulse from pulse generator 838 and the sequence of $S_{16}$ and $S_{17}$ pulses is repeated. In this way, the set of Z(0), Z(1), . . . , Z(N−1) signals are inserted into FFT circuit 803. After the Z(N−1) signal is inserted into the FFT circuit, N zero signals are inserted for the 2N point operation. When counter 820 is incremented to its 2N+1 state, a high $N_4$ signal is obtained from comparator 821. Responsive to the high $N_4$ signal and the next pulse from pulse generator 838, AND gate 840 is enabled. Since signal $A_9$ from flip-flop 827 is high, AND gate 843 produces an $S_{FP}$ signal which initiates the formation of transform signals Re $X_{FFT}''(0)$, Im $X_{FFT}''(0)$, Re $X_{FFT}''(1)$, Im $X_{FFT}''(1)$, . . . , Re $X_{FFT}''(N-1)$, Im $X_{FFT}''(N-1)$ in FFT circuit 803.

Upon completion of the formation of signal Im $X_{FFT}''(N-1)$ in FFT circuit 803, and $E_3$ pulse from the FFT circuit resets flip-flop 827 and triggers pulse generator 830. The $S_{15}$ pulse from generator 830 clears counter 820 to its zero state. The next $S_{16}$ pulse from pulse generator 834 enables latch 807-0 via selector 805 and enables FFT circuit 803, whereby the Re $X_{FFT}''(0)$ signal from FFT circuit 803 is transferred to latch 807-0. Pulse $S_{17}$ from pulse generator 836 increments counter 820 to its next state and selector 805 addresses latch 808-0. The high $N_3$ signal from comparator 821 and the pulse from generator 838 enable AND gate 841 so that the $S_{16}$ and $S_{17}$ pulse sequence is repeated.

Responsive to the next $S_{16}$ pulse signal Im $X_{FFT}''(0)$ is transferred from FFT circuit 803 to latch 808-0 and counter 820 is incremented to its next state by the succeeding $S_{17}$ pulse. The repetition of the $S_{16}$ and $S_{17}$ pulse sequence successively places the Re $X_{FFT}''(k)$ and Im $X_{FFT}''(k)$ signals ($k=0, 1, \ldots, N-1$) into latches 807-0 through 808-N−1 as indicated in FIG. 8.

After the Im $X_{FFT}''(N-1)$ signal is placed in latch 808-N−1, the spectral value signals $\sigma_p(0)$, $\sigma_p(1)$, . . . , $\sigma_p(N-1)$ appear at the outputs of square root circuits 814-0 through 814-N−1, respectively. Signal $\sigma_p(0)$ is formed by squaring signal Re $X_{FFT}''(0)$ in multiplier 810-0 and squaring signal Im $X_{FFT}''(0)$ in multiplier 811-0. The outputs of multipliers 810-0 and 811-0 are summed in adder 812-0 and the square root of the sum output of adder 812-0 is obtained from square root circuit 814-0. In similar manner, the signals $\sigma_p(1)$ through $\sigma_p(N-1)$ are formed in FIG. 8.

The $S_{17}$ pulse which increments counter 820 to its $2N+1$ state which causes comparator 821 to provide a high $N_4$ signal. The $S_{17}$ pulse also triggers pulse generator 838. Responsive to the high $N_4$ signal and the pulse from generator 838, AND gate 840 is enabled. Since the $A_{10}$ signal from flip-flop 827 is high, AND gate 844 produces an $E_p$ signal (waveform 1921 in FIG. 19 at time $t_7$) which indicates the $\sigma_p(0), \sigma_p(1), \ldots, \sigma_p(N-1)$ spectral level signals are available. Each $\sigma_p(k)$ is assigned to DCT coefficient frequency index k.

The $\sigma_F(0), \sigma_F(1), \ldots, \sigma_F(N-1)$ signals from formant spectral level generator 126 and the $\sigma_p(0), \sigma_p(1), \ldots, \sigma_p(N-1)$ signals from pitch excitation spectral level generator 128 are applied to normalizer circuit 130 in which a set of joint spectral level signals $\sigma_j(0), \sigma_j(1), \ldots, \sigma_j(N-1)$ are formed.

$$\sigma_j(k)=\sigma_F(k)\sigma_p(k) \quad k=0, 1, \ldots, N-1$$

Waveform 1605 of FIG. 16 illustrates the joint spectral level signal spectrum. As indicated in waveform 1605, the pitch spectral level component modifies the formant spectral level spectrum of waveform 1603. Perceptually important fine structure is thereby added to the spectral estimate of the DCT signal spectrum for improvement of the accuracy of the transmitted speech signal segment of the DCT coefficient block. The joint spectral level signals $\sigma_j(k)$ are normalized to the discrete cosine transform spectrum shown in waveform 1601 of FIG. 16. The factor used for the normalization is generated by first determining the interval in the DCT coefficient power spectrum in which the maximum power is obtained. The power in this interval of the DCT spectrum ($P_c$) and the power in the same interval of the $\sigma_j(k)$ spectrum are then determined. The normalizing factor signal corresponding to the square root of the ratio $P_{\sigma j}/P_c$ is generated and applied to each $\sigma_j(k)$ signal.

The maximum power range is determined for the discrete cosine transform coefficient by selecting the maximum DCT coefficient signal $X_{DCT}(n^*)_{max}$ and the frequency point k corresponding thereto. A range is prescribed by dividing the number of DCT coefficient frequencies N by the decoded pitch signal P' and lower and upper limits $$I_E=n^*-N/P'$$

$$I_S=n^*+N/P' \tag{11}$$

are calculated. The power of the DCT spectrum in the range between $I_E$ and $I_S$ is then determined as $$P_C=\sum_{n=I_E}^{I_S} X^2_{DCT}(n). \tag{12}$$

In similar manner, the power of the joint spectral values $\sigma_j(k)$ in the range between $I_E$ and $I_S$ is calculated as $$P_{\sigma j}=\sum_{n=I_E}^{I_S} \sigma_j^2(n) \tag{13}$$

The normalizing factor for each spectral value signal is then $$P_N=\sqrt{\frac{P_{\sigma j}}{P_C}}. \tag{14}$$

Figure 2:
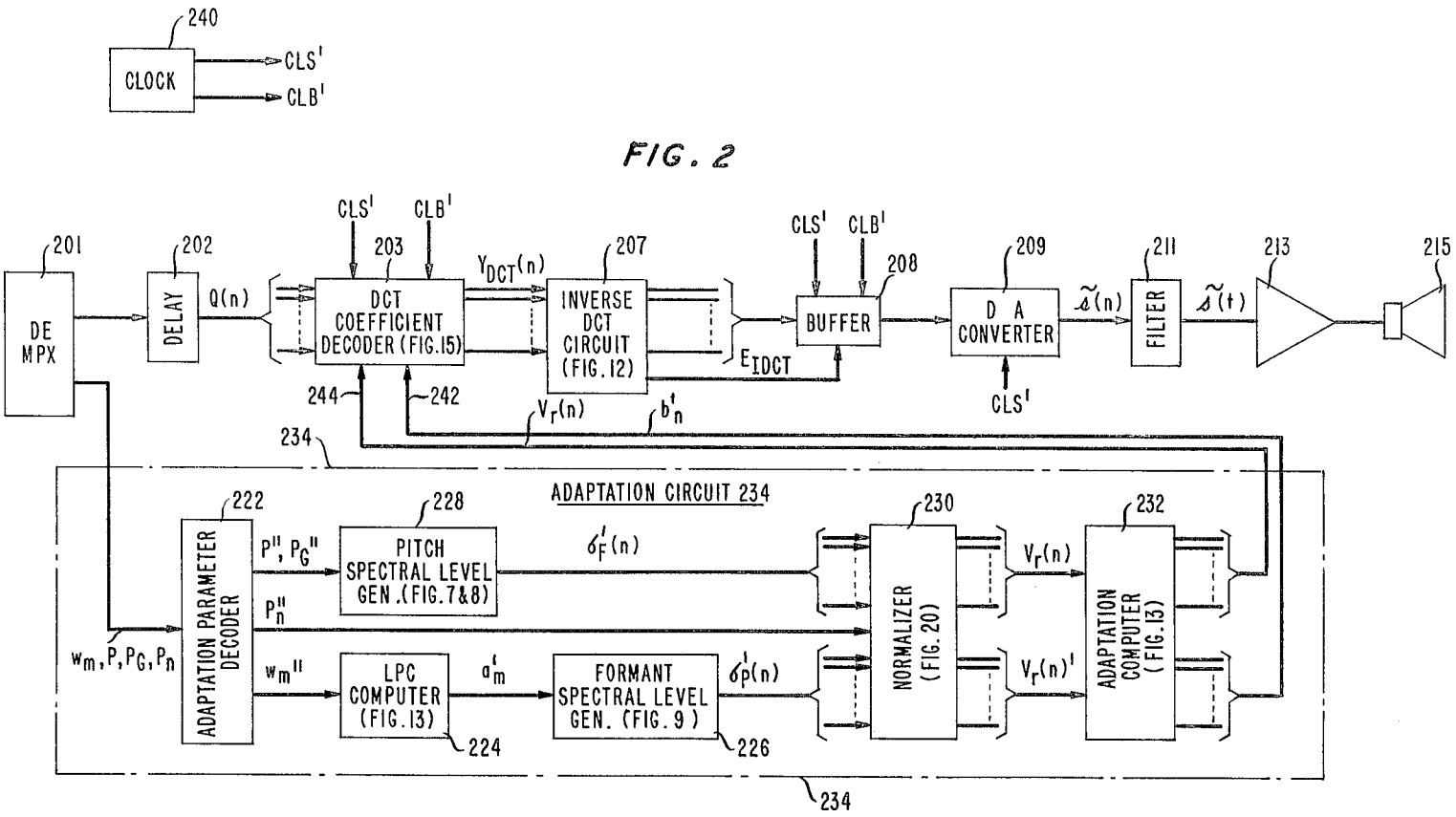
FIG. 2 depicts a general block diagram of a speech signal decoder illustrative of the invention.

The $P_N$ signal is used to normalize the joint spectral level signals $\sigma_j(k)$ and is also encoded and transmitted to the circuit of FIG. 2 via multiplexor 112 and communication channel 140. Each normalized joint spectral value signal becomes $$V(n)=P_N\sigma_j(n). \tag{15}$$

It is also desirable to adjust the magnitude of the quantizing error at each DCT coefficient frequency so that the signal to quantizing noise ratio is always above a predetermined minimum throughout the spectrum. Such adjustment requires generation of a set of modified normalized joint spectral value signals V' (n) in accordance with $$V'(n)=V(n)\sigma_F^{\gamma}(n)k_n;\ n=0,1,\ldots,N-1 \tag{16}$$

where $\gamma$ and $k_n$ are predetermined constants. The V'(n) signals are utilized in adaptation computer 132 to control the allocation of bits in the quantization of the DCT coefficient signals in quantizer 109.

Figure 10:
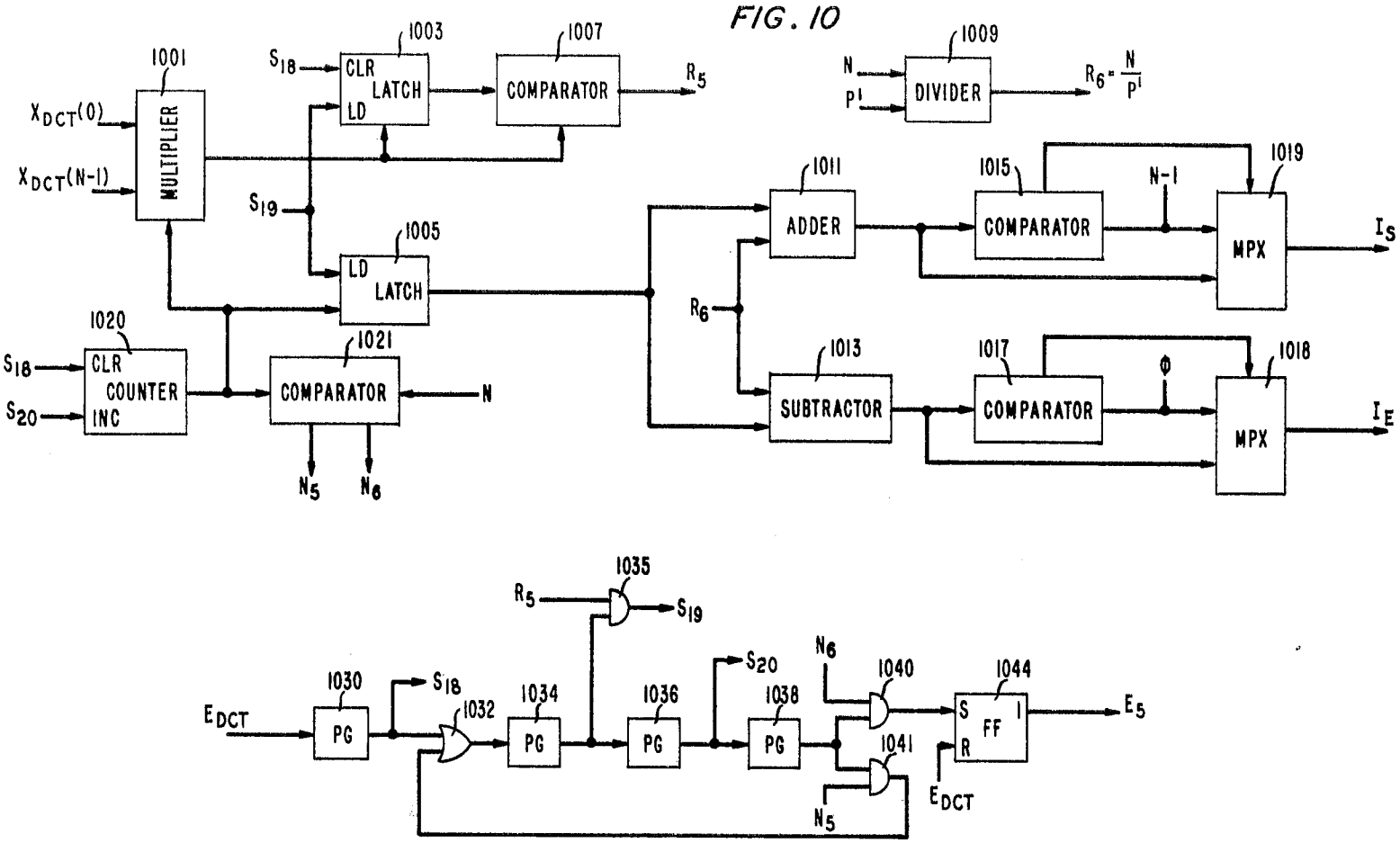
FIGS. 10 and 11 show a detailed block diagram of the normalizer circuit used in the circuit of FIG. 1.
Figure 11:
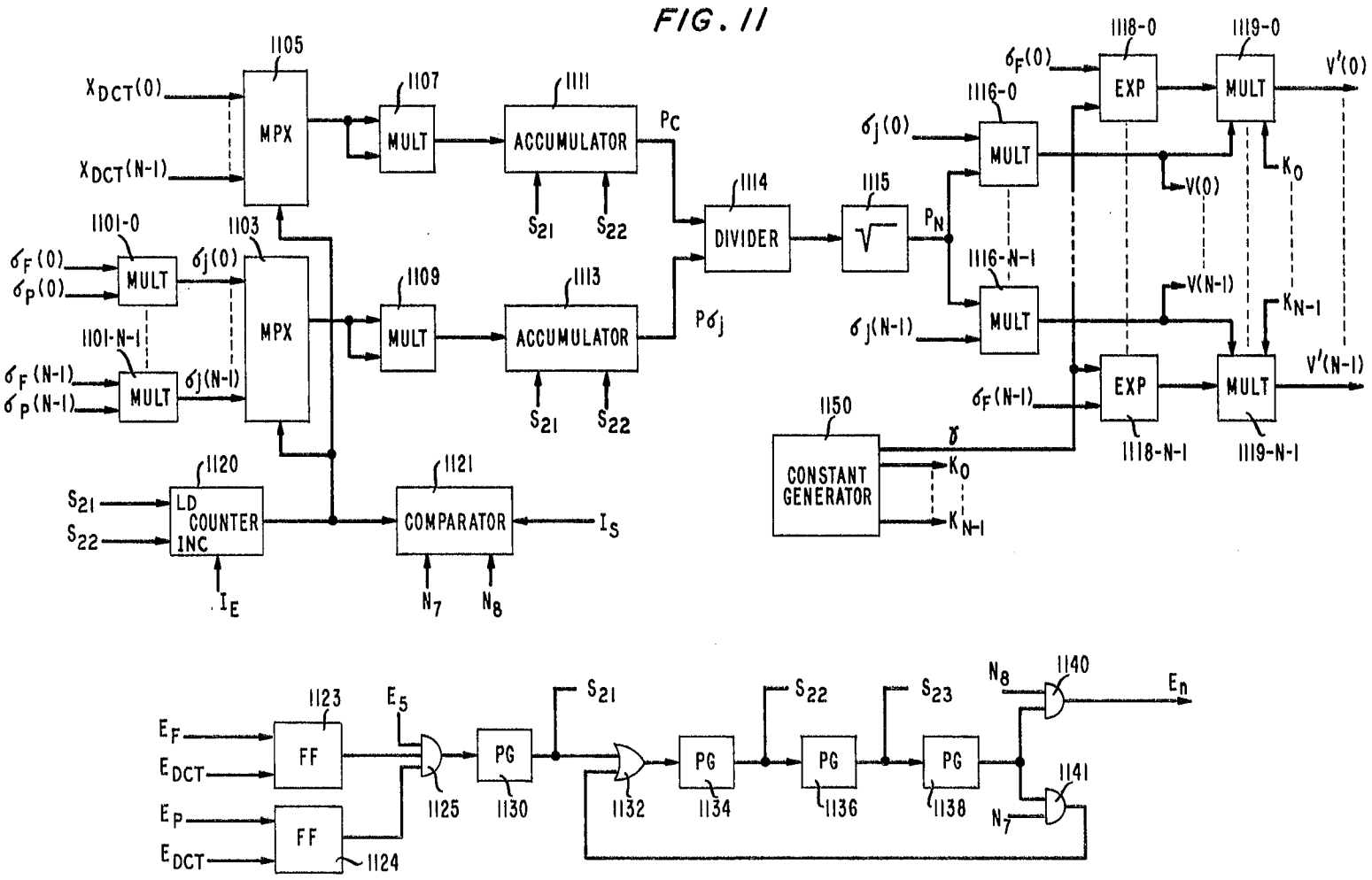

Normalizer 130 is shown in greater detail in FIGS. 10 and 11. The block diagram of FIG. 10 is utilized to provide the lower and upper limit signals $I_E$ and $I_S$ in accordance with equation 11. The circuit of FIG. 11 is used to generate the V(n) and V'(n) signals of equations 15 and 16, respectively. Referring to FIG. 10, multiplexor 1001 provides the sequence of DCT coefficient signals $X_{DCT}(0), X_{DCT}(1), \ldots, X_{DCT}(N-1)$ under control of counter 1020. Comparator 1007 compares the signal in latch 1003 to the incoming $X_{DCT}(n)$ signal. The larger signal is placed in latch 1003 and the index n of the larger signal is placed in latch 1005. In this manner, the maximum $X_{DCT}(n)$ signal is selected and the frequency index n of said maximum $X_{DCT}(n)$ signal is placed in latch 1005.

Responsive to the $E_{DCT}$ pulse (waveform 1905 in FIG. 19) from discrete cosine transformation circuit 107 occurring at time $t_1$, pulse generator 1030 produces control pulse $S_{18}$ which clears counter 1020 to its zero state and clears latch 1003 to zero. The output of counter 1020 causes the $X_{DCT}(0)$ signal from DCT circuit 107 to be applied to both latch 1003 and comparator 1007. Comparator 1007 provides a high $R_5$ signal to AND gate 1035 if $X_{DCT}(0)$ is greater than the signal in latch 1003. Responsive to the pulse from pulse generator 1034 (triggered by the $S_{18}$ pulse), AND gate 1035 produces an $S_{19}$ pulse. The $X_{DCT}(0)$ signal is then placed in latch 1003 and the n=0 frequency index signal is inserted into latch 1005. An $S_{20}$ control pulse is then produced by pulse generator 1036, which $S_{20}$ pulse increments counter 1020 to its next state. The state of counter 1020 is compared to N in comparator 1021, and a high $N_5$ signal is obtained since the state of counter 1020 is less than N. The high $N_5$ signal and the pulse from generator 1038 enable AND gate 1041 so that the sequence of pulses from generators 1034, 1036 and 1038 is repeated.

The $X_{DCT}(1)$ signal is applied to comparator 1007 wherein it is compared to the $X_{DCT}(0)$ signal in latch 1003. If $X_{DCT}(0) \geqq X_{DCT}(1)$, the $R_5$ output of comparator 1007 is low and the $X_{DCT}(0)$ signal remains in latch 1003. If, however, $X_{DCT}(0) \geqq X_{DCT}(1)$ signal $R_5$ is high and the $X_{DCT}(1)$ signal is inserted into latch 1003 while the n=1 frequency index code is put into latch 1005 by pulse $S_{19}$ from AND gate 1035. Until counter 1020 is put into its $N^{th}$ state, each sequence of pulses from pulse generators 1034, 1036 and 1038 causes the incoming $X_{DCT}(n)$ signal to be compared to the previously determined maximum signal stored in latch 1003. After counter 1020 is in its $N^{th}$ state, the maximum $X_{DCT}(n)$ is in latch 1003 and the corresponding frequency index is in latch 1005.

During the determination of the maximum $X_{DCT}(n)$ signal by comparator 1007, divider 1009 produces an $R_6=N/P$, range signal. Signal $R_6$ is applied to one input of adder 1011 and one input of subtractor 1013. Adder 1011 is operative to form the $I_S$ signal and subtractor 1013 is operative to form the $I_E$ signal according to equation 11. The output of adder 1011 is compared to N−1, the largest possible spectral frequency index, in comparator 1015, while the output of subtractor 1013 is compared to zero, the minimum spectral frequency index, in comparator 1017. In the event $I_S$ from adder 1011 is greater than N−1, multiplexor 1019 is enabled to provide an $I_S=N-1$ output. Similarly, in the event the output of subtractor 1013 is less than zero, multiplexor 1018 is enabled to produce an $I_E=0$ signal.

When counter 1020 is incremented to its $N^{th}$ state, a high $N_6$ is obtained from comparator 1021. AND gate 1040 is then enabled by the high $N_6$ signal and the pulse from pulse generator 1038. The output of gate 1040 sets flip-flop 1044 to its one state. The high $E_5$ signal obtained from flip-flop 1044 in its set state is applied to AND gate 1125 in FIG. 11. After signals $\sigma_F(0)$, $\sigma_F(1)$, . . . , $\sigma_F(N-1)$ are available at the outputs of formant spectral level generator 126, the $E_F$ signal (waveform 1919 in FIG. 19) from circuit 126 sets flip-flop 1123 which was previously reset by the $E_{DCT}$ signal from DCT circuit 107. Similarly, when signals $\sigma_p(0)$, $\sigma_p(1)$, . . . , $\sigma_p(N-1)$ are available at the outputs of pitch excitation spectral level generator 128, the $E_p$ signal (waveform 1921 in FIG. 19) therefrom sets flip-flop 1124.

AND gate 1125 is enabled by the coincidence of high signals from the 1 outputs of flip-flops 1044, 1123, and 1124 occurring at time $t_8$ in FIG. 19. Responsive to a high signal from AND gate 1125, pulse generator 1130 provides an $S_{21}$ pulse. The $S_{21}$ pulse is operative to load the $I_E$ signal from multiplexor 1019 in FIG. 10 into counter 1120, to clear accumulators 1111 and 1113, and to trigger pulse generator 1134. At this time, the $I_E$ address output of counter 1120 is applied to multiplexors 1103 and 1105. Consequently, the $X_{DCT}(I_E)$ signal is supplied to the inputs of multiplier 1107 wherein the signal $X_{DCT}^2(I_E)$ is formed. Multiplexor 1103 is operative to connect the output of multiplier 1101-0 to the inputs of multiplier 1109 wherein the signal $\sigma_j^2(I_E)=[\sigma_F(I_E)\cdot\sigma_p(I_E)]^2$ is formed. Accumulator 1111 stores signal $X_{DCT}^2(I_E)$ and accumulator 1113 stores signal $\sigma_j^2(I_E)$ responsive to control pulse $S_{22}$ from pulse generator 1134.

Until counter 1120 is incremented to its $I_S+1$ state, a high $N_7$ signal is produced by comparator 1121 and the sequence of $S_{22}$ and $S_{23}$ pulses is repeated responsive to the operation of AND gate 1141. As previously described, each sequence of $S_{22}$ and $S_{23}$ pulses causes accumulator 1111 to be incremented by the next $X_{DCT}^2(n)$ signal and accumulator 1113 to be incremented by the next $\sigma_j^2(n)$ signal. After counter 1120 is in its $I_S+1$ state, accumulator 1111 contains signal $P_C$ and accumulator 1113 contains signal $P_{\sigma j}$ in accordance with equations 12 and 13, respectively. Divider 1114 is operative to form the ratio $P_{\sigma j}/P_C$ and the normalizing signal $P_N$ (equation 14) is obtained from square root circuit 1115. The $P_N$ signal is applied to one input of each of multipliers 1116-0 through 1116-N−1 which multipliers are used to form the normalized joint spectral level signals. Multiplier 1116-0, for example, generates the signal $V(0)=\sigma_j(0)\cdot P_N$. Multiplier 1116-N−1 generates the signal $V(N-1)=\sigma_j(N-1)\cdot P_N$. Similarly, multipliers 1116-1 through 1116-N−2 (not shown) generate normalized spectral level signals $V(1)=\sigma_j(1)\cdot P_N$ through $V(N-2)=\sigma_j(N-2)\cdot P_N$ in accordance with equation 15. Signal $P_N$ is applied to encoder 142 in FIG. 1 wherein it is encoded. The encoded $P_N$ is applied to multiplexor 112.

The V′(n) signals of equation 16 are generated by the combination of exponent and multiplier circuits 1118-0 through 1118-N−1 and 1119-0 through 1119-N−1, respectively. For example, spectral level signal $\sigma_j(0)$ is raised to the $\gamma$ power in exponent circuit 1118-0 to which the constant $\gamma$ is applied fron constant generator 1150. The resulting output $\sigma_j^{\gamma}(0)$ is multiplied by signal V(0) from multiplier 1116-0 and constant $k_0$ from constant generator 1050 in multiplier 1119-0 to form the V′(0) signal. The V′(1) through V′(N−1) signals are generated in similar manner.

After the format spectral level signals and pitch excitation spectral level signals are combined and normalized to the power $P_N$ in maximum power interval of the discrete cosine transform coefficient spectrum in normalizer 130, an $E_n$ signal (waveform 1923 in FIG. 19) is produced by AND gate 1140 at time $t_9$. At this time the V(n) and V′(n) outputs from multipliers 1116-0 through 1116-N−1 and multipliers 1119-0 through 1119-N−1 are applied to adaptation computer 132. The adaptation computer is operative to form a step size control signal and a bit assignment control signal for each DCT coefficient signal $X_{DCT}(n)$ from delay 108.

Figure 17:
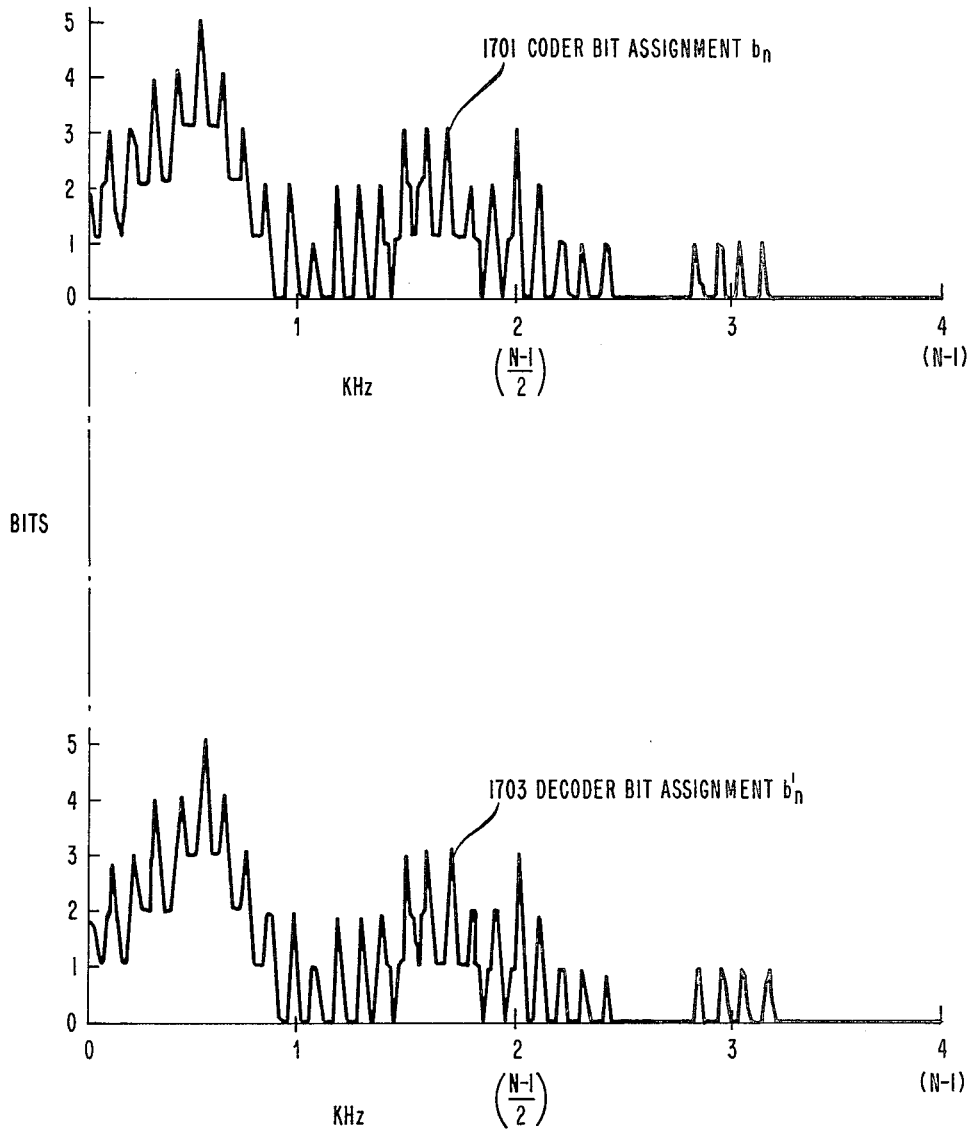

The step size control signal for transform coefficient frequency index n is utilized in quantizer 109 to modify the magnitude of the $X_{DCT}(n)$ signal whereby the formant and pitch predictable components are divided out of the $X_{DCT}(n)$ signal. The bit assignment control signal determines the number of bits $b_n$ for each transform coefficient frequency index n. While the total number of bits for each block is predetermined, the allocation of bits to the DCT coefficient signals $X_{DCT}(n)$ is variable and a function of the perceptual importance of the $X_{DCT}(n)$ coefficient signal in the spectrum. Signals V′(n) provide an estimate of the spectrum of the block speech segment based on the formant and pitch excitation speech model adjusted by parameters $\gamma$ and $k_n$ for quantizing noise control. In the circuit of FIG. 1, the number of bits is allocated to a transform coefficient frequency for which V′(n) is relatively high is greater than the number of bits allocated to a transform coefficient frequency for which V′(n) is relatively low. Consequently, spectrum regions of high speech signal energy are more accurately encoded than regions of low speech energy. Waveform 1701 of FIG. 17 illustrates the bit assignments generated for the joint spectral level spectrum shown in waveform 1605 of FIG. 16.

Adaptation computer 132 may comprise the processing arrangement of FIG. 13 wherein controller 1307 is enabled by signal $E_n$ (waveform 1923 in FIG. 19) from normalizer 130 to connect adaptation program store 1306 to processor 1309. Program store 1306 stores the instruction codes required to generate the bit assignment signals $b_n$ of waveform 1701 and to store the V(n) signals for use in quantizer 109. The adaptation program instruction codes are listed in Fortran language in appendix C.

Responsive to signal $E_n$, processor 1309 is operative to transfer signals V(n) and V'(n) to data memory 1316 via input/output interfaces 1318 under control of central processor 1312.

Figure 14:
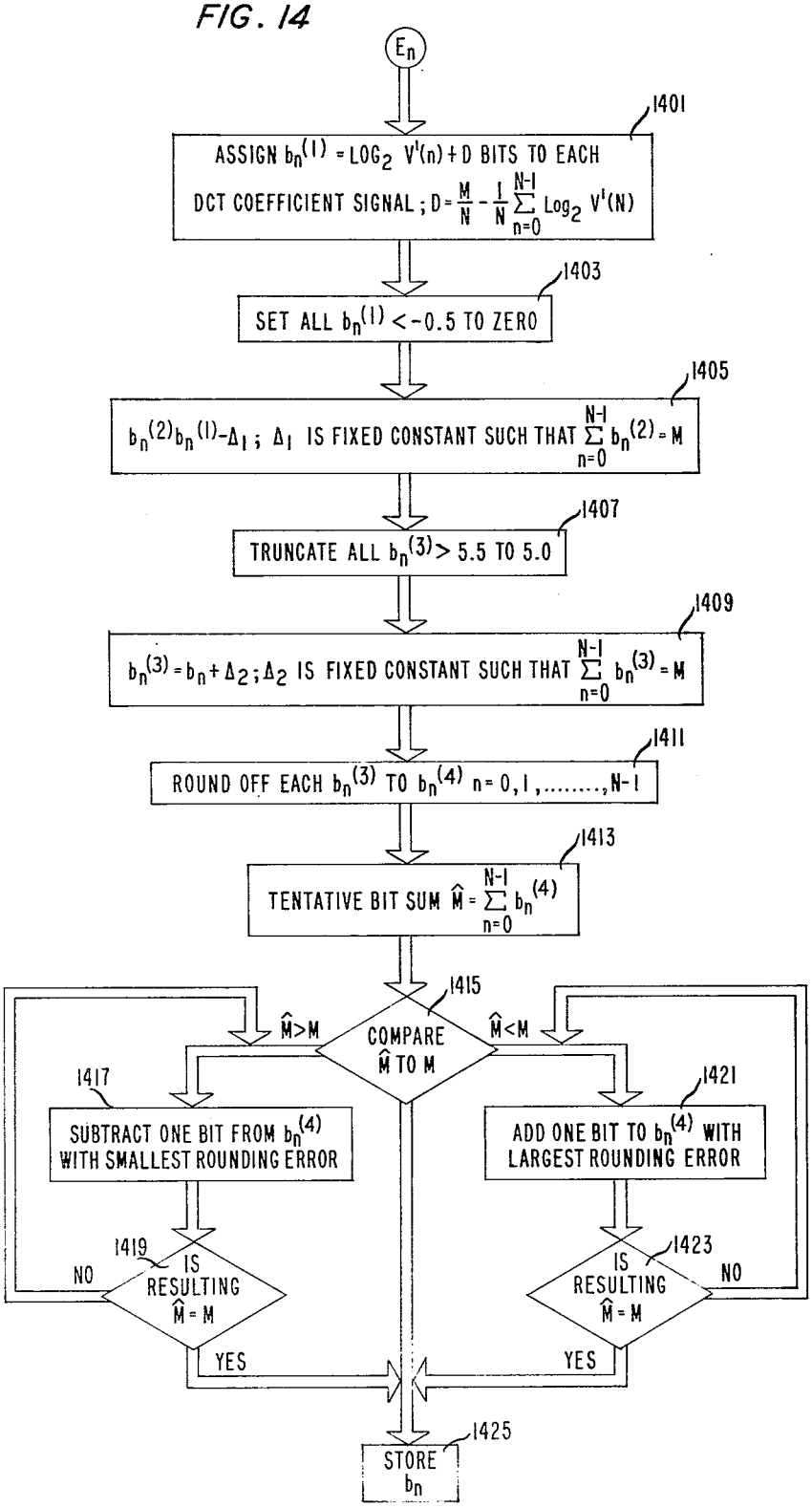
FIG. 14 shows a flow chart illustrative of the bit allocation operations of the circuits of FIGS. 1 and 2.

The bit allocation process is illustrated in the flow chart of FIG. 14. Referring to FIG. 14, signal $E_n$ causes processor 1309 to generate an initial bit assignment for each transform coefficient signal in accordance with $$b_n^{(1)} = \log_2 V'(n) + D$$

where $$D = \frac{M}{N} - \frac{1}{N} \sum_{n=0}^{N-1} \log_2 V'(n)$$

where M is the total number of bits in the block and N is the total number of transform coefficient signals as shown in operation box 1401. After the initial bit assignment is completed, $b_n^{(1)}$ which are less than $-0.5$ are set to zero as indicated in operation box 1403 and the second bit assignment is made in accordance with $$b_n^{(2)} = b_n^{(1)} - \Delta_1$$

$\Delta_1$ is a fixed constant such that $$\sum_{n=0}^{N-1} b_n^{(2)} = M \tag{17}$$

as shown in operation box 1405. The $b_n^{(2)}$ assignment codes which are greater than 5.5 are reduced to 5.0 (operation box 1407) and a third bit assignment is processed according to $$b_n^{(3)} = b_n^{(2)} + \Delta_2 \tag{18}$$

$\Delta_2$ is a fixed constant such that $$\sum_{n=0}^{N-1} b_n^{(3)} = M$$

The $b_n^{(3)}$ assignment signals from operation box 1409 are rounded to the nearest integer to form the $b_n^{(4)}$ bit assignment signals as in operation box 1411 and a tentative sum of the $b_n^{(4)}$ signals is formed (operation box 1413) in accordance with $$\hat{M} = \sum_{n=0}^{N-1} b_n^{(4)}. \tag{19}$$

Decision box 1415 is then entered to compare the tentative sum $\hat{M}$ to the total number of bits (M) in the block. If $\hat{M} > M$, the $b_n^{(4)}$ signal with the smallest rounding error is reduced by one bit (operation box 1417) and the resulting tentative sum $\hat{M}$ is compared to M (operation box 1419). The reduction of bits in operation box 1417 is repeated until $\hat{M} = M$.

In the event that $\hat{M} < M$ in operation box 1415, one bit is added to the $b_n^{(4)}$ having the largest rounding error as in operation box 1421. The resulting $\hat{M}$ from operation box 1421 is compared to M in decision box 1423 and the addition of bits in operation box 1421 is repeated until $\hat{M} = M$. When $\hat{M} = M$, the final bit assignment signals $b_n$ from data memory 1316 via are transferred to store 1335 $b_n$ from data memory 1316 via are transferred to store 1335 via input/out interface 1318. The V(n) codes from data memory 1316 are also transferred to store 1334 via input/output interface 1318.

Table 1 shows an illustrative example of bit allocation for an arrangement in which there are N=8 discrete cosine transform coefficient signals and M=20 total number of bits for each block.

TABLE 1

| | BIT ALLOCATION | | | | | | | |
|---|---|---|---|---|---|---|---|---|
| Frequency Index n= | 0 | 1 | 2 | 3 | 4 | 5 | 6 | 7 |
| 1. V'(n) | 20 | 100 | 35 | 7 | 2 | 9 | 5 | 0.5 |
| 2. $\log_2 V_n'(n)$ | 4.32 | 6.64 | 5.13 | 2.81 | 1.00 | 3.17 | 2.32 | −1.0 |
| 3. $b_n^{(1)}$ | 3.77 | 6.09 | 4.58 | 2.26 | 0.45 | 2.62 | 1.78 | −1.55 |
| 4. $b_n^{(1)} < -0.5$ to Φ | 3.77 | 6.09 | 4.58 | 2.26 | 0.45 | 2.62 | 1.78 | 0 |
| 5. $b_n^{(2)}$ | 3.55 | 5.87 | 4.36 | 2.04 | 0.23 | 2.40 | 1.55 | 0 |
| 6. $b_n^{(2)} > 5.0$ to 5.0 | 3.55 | 5.0 | 4.36 | 2.04 | 0.23 | 2.40 | 1.55 | 0 |
| 7. $b_n^{(3)}$ | 3.70 | 5.0 | 4.51 | 2.19 | 0.37 | 2.54 | 1.69 | 0 |
| 8. $b_n^{(4)}$ | 4 | 5 | 5 | 2 | 0 | 3 | 2 | 0 |
| 9. Error | −0.3 | 0 | −0.49 | 0.19 | −0.14 | −0.46 | −0.31 | 0 |
| 10. $b_n$ | 4 | 5 | 4 | 2 | 0 | 3 | 2 | 0 |

Rows 1 and 2 of Table 1 list the V'(n) and $\log_2$ V'(n) signal values, respectively. Row 3 lists the initial $b_n^{(1)}$ bit assignments according to operation box 1401 of FIG. 14. The $b_7^{(1)}$ assignment is $-1.55$. In accordance with operation box 1403, $b_7^{(1)}$ assignment is set to zero as shown in row 4. All other bit assignments in row 4 remain unchanged since they are greater than $-0.5$.

Row 5 shows the bit assignments $b_n^{(2)}$ which are decreased in accordance with operation box 1405 to account for the deletion of the $b_7^{(1)} = -1.55$ bit assignment. The bit assignments in row 6 are the same as row 5, except for $b_1^{(2)}$ which is changed as per operation box 1407 from 5.87 to 5.0. The bit assignments $b_n^{(3)}$ in row 7 are increased to account for the change in bit assignment $b_1^{(2)}$ according to operation box 1409. The $b_7^{(2)}$ assignment, however, remains zero.

Row 8 shows the bit assignments $b_n^{(4)}$ resulting from rounding off the $b_n^{(3)}$ bit assignments as per operation box 1411. Row 9 lists the rounding errors $b_n^{(3)} - b_n^{(4)}$. Since the sum of the bit assignments in row 8 is $\hat{M} = 21$, one bit is subtracted from the $b_2^{(4)}$ assignment which has the smallest (most negative) rounding error in row 9 (operation box 1417). The resulting bit assignment sum of row 10 is $\hat{M} = M = 20$ and the final bit assignments $b_n$ (row 10) for the block are stored in store 1335 for use in quantizer 109. The bit assignment in row 10 is a function of V'(n) in row 1. Thus, $b_1$ is 5 for V'(1)=100 but $b_4$ is zero for V'(4)=2. The foregoing illustrative example uses 8 DCT coefficient signals for purposes of simplification. In actual practice, a larger set of coefficients, e.g. 256, are utilized for each block. The method of bit allocation shown in FIG. 14, however, remains the same.

The V(n) signals from adaptation computer 132 are applied to dividers 110-1 to 110-N−1 in quantizer 109 whereby each $X_{DCT}(n)$ signal from delay 108 is divided by the corresponding V(n) signal. For example, the $X_{DCT}(0)$ signal is divided by signal V(0) from computer 132 in divider 110-0 to produce the signal $X_{DCT}(0)/V(0)$. In similar manner, dividers 110-1 through 110-N−1 produce the signals $X_{DCT}(1)/V(1)$, $X_{DCT}(2)/V(2)$, . . . , $X_{DCT}(N-1)/V(N-1)$, respectively. The output of divider 110-0 is applied to quantizer 111-0 which is operative responsive to the coded bit assignment signal $b_0$ from computer 132 to quantize signal $X_{DCT}(0)/V(0)$ to produce a digital code Q(0) of $b_0$ bits representative of signal $X_{DCT}(0)/V(0)$. Quantizers 111-1 through 111-N−1 similarly produce digital codes Q(1), Q(2), . . . , Q(N−1) for the $X_{DCT}(1)/V(1)$ through $X_{DCT}(N-1)/V(N-1)$ signals. The number of bits in the digital code Q(n) for signal $X_{DCT}(n)/V(n)$ is determined by the $b_n$ assignment signal from computer 132. The N output codes from quantizer 109, Q(0), Q(1), . . . , Q(N−1) are applied to multiplexor 112 together with the $w_m$, P and $P_G$ signals obtained from encoder 120 and the $P_N$ signal obtained from encoder 144. Multiplexor 112 is operative, as is well known in the art, to sequentially apply the digitally coded signals at its inputs to communication channel 140.

FIG. 2 shows a general block diagram of a speech signal decoder illustrative of the invention. The decoder of FIG. 2 is operative to receive the adaptively quantized discrete cosine transform coefficient codes Q(n), the prediction parameter signal codes $w_m$ and the coded signals P, $P_G$, and $P_N$ for each block from communication channel 140 and to produce a reconstructed speech signal $\tilde{s}(t)$ corresponding to the block. The Q(n) signal codes are separated from the $w_m$ codes and the P, $P_G$, $P_N$ coded signals by demultiplexor 201 which applies signals Q(n) to DCT coefficient decoder 203 via delay 202. The $w_m$, P, $P_G$, and $P_N$ signals from demultiplexor 201 are supplied to decoder 222 in adaptation circuit 234 which circuit provides adaptation signals $V_r(n)$ and $b_n'$ to DCT coefficient decoder 203. Adaptation circuit 234 is similar to adaptation circuit 134 in FIG. 1, excluding circuits corresponding to autocorrelator 113, parameter computer 115, pitch analyzer 117 and encoder 120.

Decoder 222 supplies signals $w_m''$ derived from channel 140 to LPC computer 224 which is substantially similar to LPC computer 124. The $a_m'$ linear prediction coefficients generated by LPC computer 224 are utilized by formant spectral level generator 226 to produce formant spectral level signals $\sigma_F'(0)$, $\sigma_F'(1)$, . . . , $\sigma_F'(N-1)$ for the block. Circuit 226 is substantially similar to circuit 126 shown in detail in FIG. 9. The spectrum of these $\sigma_F(k)$ signals is illustrated in waveform 1607 of FIG. 16. Responsive to the P'' and $P_G''$ signals from decoder 222, pitch spectral level generator 228 produces pitch excitation spectral signals $\sigma_p'(0)$, $\sigma_p'(1)$, . . . , $\sigma_p'(N-1)$. Circuit 228 is substantially the same as circuit 128 shown in detail in FIG. 8.

Figure 20:
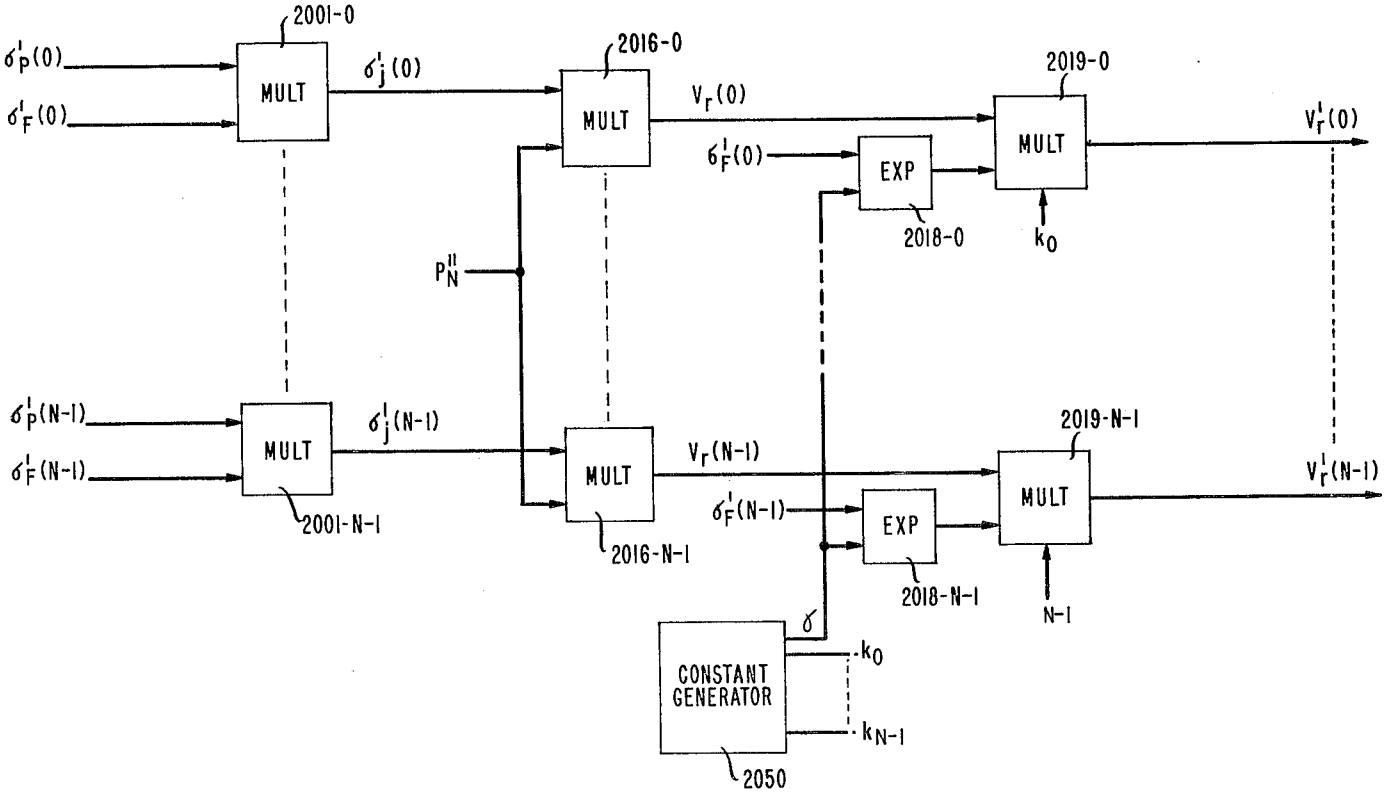
FIG. 20 shows a detailed block diagram of the normalizer circuit used in the circuit of FIG. 2.

Normalizer 230 is adapted to combine signals $\sigma_F'(k)$ and $\sigma_p'(k)$ and to normalize the resultant to the decoded signal $P_n''$ from decoder 222 as previously described with respect to FIG. 11. FIG. 20 shows a detailed block diagram of normalizer 230. Referring to FIG. 20, each of multipliers 2001-0 through 2001-N−1 is operative to form signal $$\sigma_j'(k)=\sigma_p'(k)\ \sigma_F'(k);\ k=0, 1, \ldots, N-1$$

Multiplier 2001-0 receives the $\sigma_p'(0)$ pitch excitation spectral level signal from generator 228 and the $\sigma_F'(0)$ formant spectral level signal from generator 226 and provides the joint spectral level signal $\sigma_j'(0)=\sigma_p'(0)\ \sigma_F'(0)$. In similar manner, signals $\sigma_j'(1)$, $\sigma_j'(2)$, . . . , $\sigma_j'(N-1)$ are obtained from multipliers 2001-1 through 2001-N−1, respectively. The decoded normalizing factor signal $P_N''$ from decoder 222 is applied to each of multipliers 2016-0 through 2016-N−1. Responsive to the $\sigma_j'(0)$ signal from multiplier 2001-0 and the $P_N''$ signal, multiplier 2016-0 forms the step size control signal $V_r(0)$. Similarly, the $V_r(1)$, $V_r(2)$, . . . , $V_r(N-1)$ signals are formed in multipliers 2016-1 through 2016-N−1 in accordance with $$V_r(n)=\sigma_j'(n)\cdot P_N'';\ n=0, 1, \ldots, N-1$$

The $V_r'(n)$ signals, in accordance with $$V_r'(n)=V_r(n)\sigma_F'(n)^{\gamma k_n};\ n=0, 1, \ldots, N-1$$

are generated by the combination of exponent circuits 2018-0 through 2018-N−1 and multiplier circuits 2019-0 through 2019-N−1. For example, spectral level signal $\sigma_j'(0)$ is raised to the $\gamma$ power in exponent circuit 2018-0 to which the constant $\gamma$ is applied from constant generator 2050. The resultant output $\sigma_j'(0)$ to the $\gamma$ power is multiplied by signal $V_r(0)$ from multiplier 2016-0, and the constant $k_0$ from constant generator 2050 in multiplier 2019-0 to form the $V_r'(0)$ signal. The $V_r'(1)$ through $V_r'(N-1)$ signals are generated in similar manner. The joint spectral level signal $\sigma_j'(n)$ spectrum is illustrated in waveform 1609 of FIG. 16. The outputs of normalizer 230 $V_r(n)$ and $V_r'(n)$ are supplied to adaptation computer 232 which is substantially similar to adaptation computer 132. The bit assignment codes $b_n'$ and $V_r(n)$ signals for the block are applied to DCT coefficient decoder 203 from adaptation computer 232 via lines 242 and 244, respectively.

DCT coefficient decoder 203 receives the Q(n) signals from demultiplexor 201 in serial format via delay 202. In the single bit stream of codes Q(0), Q(1), . . . , Q(N−1) from delay 202, there are no identified boundaries between successive codes. The bit assignment codes $b_n'$ from adaptation computer 232 are utilized to partition the bit stream from delay 202 into separate signals, each corresponding to a Q(n) code. Bit assignment codes $b_n'$ corresponding to $b_n$ codes of the speech encoder of FIG. 1 are shown in waveform 1803 of FIG. 18. The bit assignment code $b_0'$ is 2. Thus, the first two bits of the bit stream applied to DCT coefficient decoder 203 are separated as coded signal Q(0). Since $b_1'$ from waveform 1703 is 1, the next bit of the bit stream is segregated as coded signal Q(1). In the event a $b_n'$ code is zero, the corresponding Q(n) signal is zero and no bits are segregated.

After the Q(0), Q(1), . . . , Q(N−1) coded signals are separated, each code is decoded as is well known in the art. Each code Q(n) is multiplied by a factor $V_r(n)$ representative of the pitch excitation controlled spectral level obtained from adaptation computer 232. In this way, each Q(n) signal is converted into a discrete cosine transform coefficient signal $Y_{DCT}(n)=Q(n)\cdot V(n)$. Each $Y_{DCT}(n)$ signal corresponds to the $X_{DCT}(n)$ signal produced in DCT circuit 107 of FIG. 1. The unpredictable component of $Y_{DCT}(n)$ is supplied by the Q(n) coded signal and the predictable components of $Y_{DCT}(n)$ are supplied by the $b_n'$ and $V_r(n)$ signals which are derived from the separately transmitted $w_m$, P, $P_G$, and $P_N$ signals. The $Y_{DCT}(n)$ signals of the block, available at the outputs of DCT coefficient decoder 203, can then be converted into a sequence of signal sample replicas by inverse discrete cosine tranformation of the $Y_{DCT}(n)$ signals.

Figure 15:
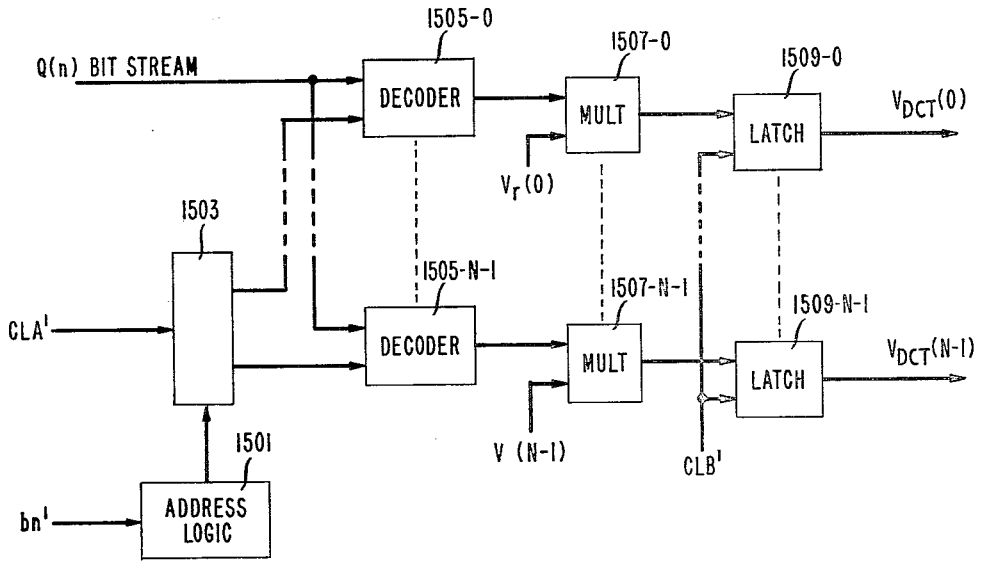
FIG. 15 shows a detailed block diagram of the DCT decoder used in the circuit of FIG. 2.

FIG. 15 shows DCT coefficient decoder 203 in greater detail. Referring to FIG. 15, the serial bit stream of Q(n) signal codes from delay 202 is applied to the data inputs of decoders 1505-0 through 1505-N−1. The bit assignment codes $b_n'$ from adaptation computer 232 are supplied to address logic 1501 which is operative to form a sequence of address codes. Address logic 1501 generates a sequence of address codes by means of a counting arrangement which is controlled by the bit assignment codes so that the same address n is supplied $b_n'$ times. The address codes from logic 1501 are applied to the address input of selector 1503. The CLS' clock pulses from clock 240 are thereby selectively applied to decoder circuits 1505-0 through 1505-N−1 and the Q(n) bits are inserted into the decoders as addressed by address logic 1501. The $b_0'$ signal, for example, causes selector 1503 to enable decoder 1505-0 during the time the Q(0) bits are present in the Q(n) serial bit stream. After the Q(0) bits are inserted into decoder 1505-0, selector 1503 enables decoder 1505-1 (not shown) responsive to the $b_1'$ assignment code applied to address logic 1501. The Q(1) bits are thereby inserted in decoder 1505-1. In similar manner, the Q(2) through Q(N−1) code bits are placed in decoders 1505-2 through 1505-N−1, respectively.

The outputs of decoders 1505-0 through 1505-N−1 are connected to the inputs of multipliers 1507-0 through 1507-N−1, respectively. Each multiplier is operative to form the product $Q(n)\cdot V_r(n)$ responsive to the code from decoder 1505-n and the $V_r(n)$ code from adaptation computer 232. The product code $Y_{DCT}(0)=Q(0)\cdot V_r(0)$ is formed in multiplier 1507-0 and the product code $Y(N-1)=Q(N-1)\cdot V_r(N-1)$ is formed in multiplier 1507-N−1. Similarly, the codes $Y_{DCT}(1)$, $Y_{DCT}(2)$, . . . , $Y_{DCT}(N-2)$ are formed in multipliers 1507-1 through 1507-N−2, respectively. After all product codes $Y_{DCT}(n)$ are available at the outputs of multipliers 1507-0 through 1507-N−1, clock pulse CLB' from clock 240 enables latches 1509-0 through 1509-N−1 and the discrete cosine transform coefficient signals $Y_{DCT}(0)$, $Y_{DCT}(1)$, . . . , $Y_{DCT}(N-1)$ are supplied to inverse DCT circuit 207.

Inverse DCT circuit 207 is adapted to form the signal sample codes Y(0), Y(1), . . . , Y(N−1) corresponding to the X(0), X(1), . . . , X(N−1) signals provided by buffer register 105 in FIG. 1 in accordance with $$Y(n) = \sqrt{\frac{1}{N}}\, Y_{DCT}(0) + \sqrt{\frac{2}{N}} \sum_{k=1}^{N-1} Y_{DCT}(k)\cos\frac{\pi}{2N}(2n+1)k \tag{20}$$

-continued $$n = 0, 1, \ldots, N-1$$

Figure 12:
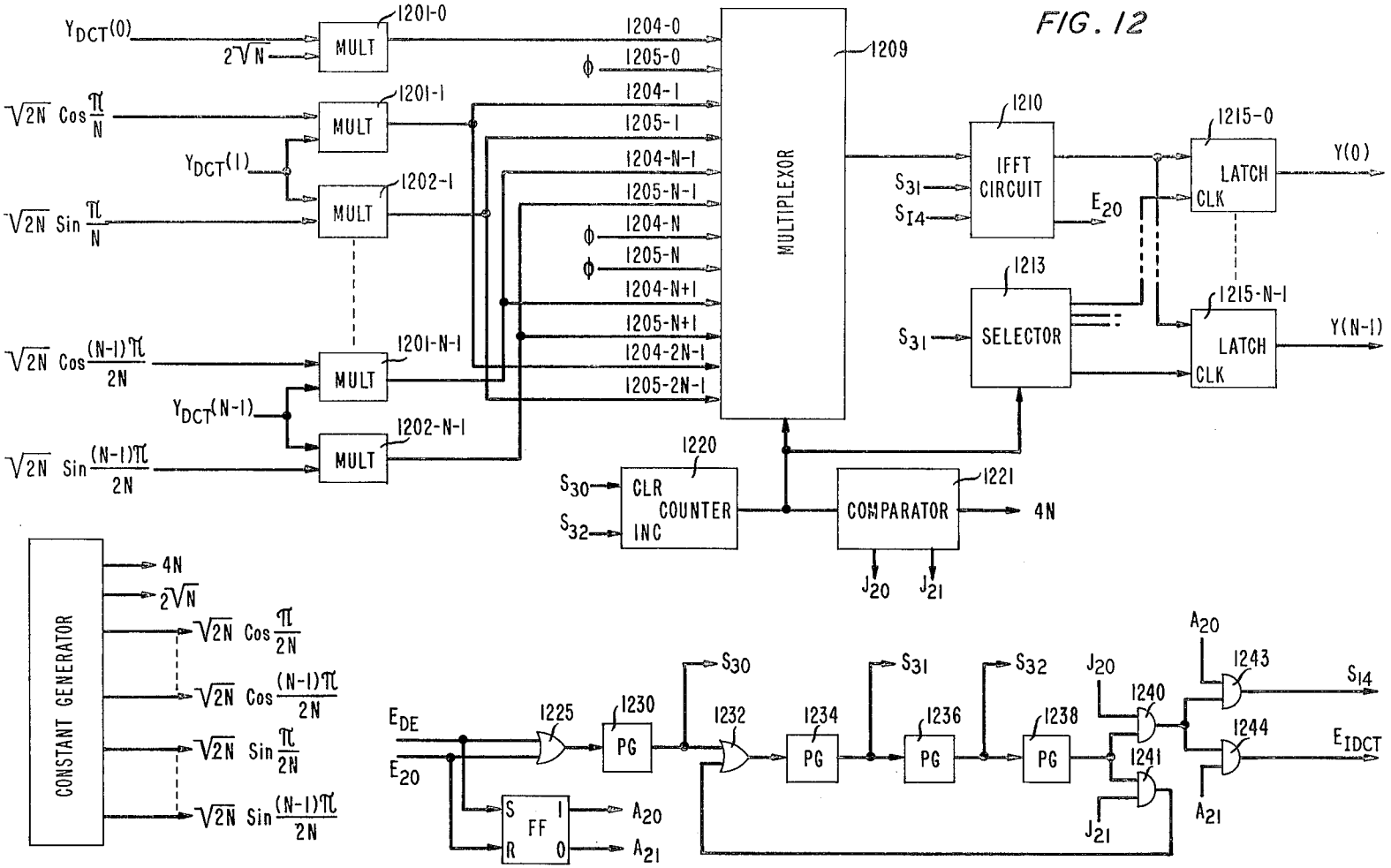
FIG. 12 depicts a detailed block diagram of the inverse discrete cosine transformation circuit used in the circuit of FIG. 2.

In the circuit of FIG. 12, signals Y(n) are generated by a 2N point inverse Fast Fourier transform method in which $$Y(n) = \frac{1}{2N} \sum_{k=0}^{2N-1} W(k) e^{j\frac{2\pi}{2N}nk} \tag{21}$$

where $$W_R(0) = 2\sqrt{N}\, Y_{DCT}(0) \quad \text{for } k = 0 \tag{22}$$

$$W_I(0) = 2\sqrt{N}\, Y_{DCT}(0)\sin 0 = 0$$

$$W_R(k) = \sqrt{2N}\, Y_{DCT}(k)\cos\frac{k\pi}{2N} \quad \text{for } k = 1, 2, \ldots, N-1 \tag{23}$$

$$W_I(k) = \sqrt{2N}\, Y_{DCT}(k)\sin\frac{k\pi}{2N}$$

$$W_R(N) = W_I(N) = 0 \quad \text{for } k = N \tag{24}$$

and $$W_R(k) = W_R(2N-k) \quad \text{for } k = N+1, N+2, \ldots, 2N-1 \tag{25}$$

$$W_I(k) = W_I(2N-k)$$

Subscript R denotes the real part and subscript I denotes the imaginary part of signal W(K).

Referring to FIG. 12, multiplier 1201-0 is operative to generate signal $W_R(0)$ responsive to signal $Y_{DCT}(0)$ and signal $2\sqrt{N}$ from constant generator 1250 in accordance with equation 22. Signal $W_R(0)$ is applied to multiplexor 1209 via line 1204-0. A zero signal corresponding to $W_I(0)$ is applied to multiplexor 1209 via lead 1205-0. In similar manner, the signals $W_R(1)$ and $W_I(1)$ are produced in multipliers 1201-1 and 1202-1, respectively. These signals are applied to multiplexor 1209 via leads 1204-1 and 1205-1 and also via leads 1204-2N−1 and 1205-2N−1 as indicated in FIG. 12 to provide the $W_R(2N-1)$ and $W_I(2N-1)$ signals. The output of multiplier 1201-N−1 is supplied to multiplexor 1209 as the $W_R(N-1)$ signal via line 1204-N−1 and as the $W_R(N+1)$ via line 1204-N+1. The output of multiplier 1202-N−1 is applied to multiplexor 1209 as the $W_I(N-1)$ signal via line 1205-N−1 and as the $W_I(N+1)$ signal via line 1205-N+1 in accordance with equation 25. Zero signals are applied to multiplexor 1209 via leads 1204-N and 1205-N in accordance with equation 24. The 4N $W_R(k)$ and $W_I(k)$ signals are sequentially inserted into IFFT circuit 1210 under control of counter 1220. IFFT circuit 1210 is operative to form the signals Y(n) of the block where n=0, 1, . . . , N−1 in accordance with equation 21.

Responsive to the CLB' signal occurring when the $Y_{DCT}(0)$, $Y_{DCT}(1)$, . . . , $Y_{DCT}(N-1)$ signals are available from DCT coefficient decoder 203, flip-flop 1227 provides a high $A_{20}$ signal and pulse generator 1230 provides an $S_{30}$ control pulse which pulse clears counter 1220 to its zero state. Multiplexor 1209 then connects line 1204-0 to the input of IFFT circuit 1210. Upon termination of pulse $S_{30}$, and $S_{31}$ pulse is obtained from pulse generator 1234 which $S_{31}$ pulse inserts the $W_R(0)$ signal into IFFT circuit 1210. The $S_{32}$ pulse produced by generator 1236 at the trailing edge of the $S_{31}$ pulse then increments counter 1220 to its first state. The sequence of $S_{31}$ and $S_{32}$ pulses is repeated responsive to comparator 1221 providing a high $J_{20}$ signal when the state of counter 1220 is less than or equal to 4N. The next $S_{31}$ pulse inserts signal $W_I(0)=0$ into IFFT circuit 1210 and the succeeding $S_{32}$ pulse increments counter 1220. In this way, signals $W_R(0)$, $W_I(0)$, $W_R(1)$, $W_I(1)$, . . . , $W_R(N-1)$, $W_I(N-1)$ are sequentially entered into IFFT circuit 1210 in ascending order. When counter 1220 is in its $2N^{th}$ and $2N+1^{th}$ states, the $W_R(N)=0$ and $W_I(N)=0$ signals are put into IFFT circuit 1220. Between states 2N+2 and 4N, the sequence of $W_R(N-1)$, $W_I(N-1)$, $W_R(N-2)$, $W_I(N-2)$, . . . , $W_R(1)$, $W_I(1)$ are inserted into IFFT circuit 1210 in descending order.

When counter 1220 is incremented to its 4N+1 state by an $S_{32}$ pulse, signal $J_{21}$ from comparator 1221 becomes high. AND gate 1240 is enabled, and an $S_{I4}$ pulse is obtained from AND gate 1243. In response to pulse $S_{I4}$, IFFT circuit 1210 is rendered operative to form signals Y(n) in accordance with equation 21. After the formation of signal Y(N−1), and $E_{20}$ pulse is obtained from IFFT circuit 1210 which $E_{20}$ pulse resets flip-flop 1227 and causes pulse generator 1230 to produce another $S_{30}$ pulse. This $S_{30}$ pulse again clears counter 1220 to its zero state preparatory to the transfer of signals Y(0), Y(1) . . . , Y(N−1) from ifft circuit 1210 to latches 1215-0 through 1215-N−1. The zero state address from counter 1220 allows the succeeding $S_{31}$ pulse from pulse generator 1234 to clock latch 1215-0 via selector 1213 and to enable IFFT circuit 1210 so that the Y(0) signal from the IFFT circuit is entered into latch 1215-0. The $S_{32}$ pulse is then produced by pulse generator 1236 and counter 1220 is incremented to its next state. Between states 0 and N−1 of counter 1220, signals Y(1), Y(2), . . . , Y(N−1) are sequentially transferred to latches 1215-1 to 1215-N−1, respectively, under control of selector 1213.

When counter 1220 reaches its 4N+1 state, AND gates 1240 and 1244 are enabled responsive to the pulse from pulse generator 1238 and the high $J_{21}$ and $A_{21}$ signals whereby an $E_{IDCT}$ pulse is produced by gate 1244. The $E_{IDCT}$ pulse permits the transfer of the Y(0), Y(1), . . . , Y(N−1) signals to buffer register 208 which is operative, as is well known in the art, to temporarily store the Y(0), Y(1), . . . , Y(N−1) signals and to convert them into a serial sequence at the clock rate of the system, e.g., 1/(8 kHz). The Y(n) sequence from buffer register 208 is converted into analog speech sample signals $\tilde{s}(n)$ in D/A converter 209. The analog sample signals $\tilde{s}(n)$ representative of the speech signal segment of the block are low-pass filtered in filter 211 to produce a speech signal replica $\tilde{s}(t)$, as is well known in the art. After suitable amplification in amplifier 213, the $\tilde{s}(t)$ signal is converted into speech waves by transducer 215.

Logic and arithmetic circuits such as gates, counters, multiplexors, comparators, encoders, decoders, adders, subtractors, and accumulators used in the circuits of FIGS. 3 through 12, 15 and 20 are well known in the art and may comprise the circuits described in the TTL Data Book for Design Engineers, Texas Instrument, Inc., 1976. The multiplier circuits shown in FIGS. 4, 5, 8, 9, 11, 12, 15, and 20 may be the MP12AJ circuit made by T.R.W., Inc. The square roots circuits 814-0 through 814-N−1, 914-0 through 914-N−1 and the exponent circuits 1118-0 through 1118-N−1 and 2018-0 through 2018-N−1 may each be implemented with a programmable read only memory such as the Texas Instrument, Inc. type 74LS471 used as a look-up table as is well known in the art. The fast Fourier transform circuits 803, 903 and Inverse fast fourier transform circuits 505 and 1210 may comprise the circuitry disclosed in the aforementioned Smith patent.

The invention has been described with reference to one illustrative embodiment thereof. It is to be understood that various modifications and changes may be made thereto by one skilled in the art without departing from the spirit and scope of the invention. For example, while the illustrative example herein utilizes a discrete cosine transform arrangement, it is to be understood that any other discrete frequency domain transform arrangement such as a discrete fourier transform may also be used.

```
C
C                    APPENDIX A
C
C
C              LPC ANALYSIS PROGRAM
C
C
CC
        SUBROUTINE LPCF(R,W)
C
C
C
C     AUTOCORRELATION COEFFICIENTS TO PARCOR COEFFICIENTS
C          R=UNNORMALIZED AUTOCORRELATION COEFFICIENTS
C               R(1)=POWER,R(I),I=1,...,13
C          W=PARCOR COEFFICIENTS, REFLECTION COEFFICIENTS
C               W(I),I=1,...,12
CC
        DIMENSION W(13),A(13),R(256),APREV(14)
        M=12
      I=1
      RES=0.
```

```
      RES=R(I)
10    W(I)=0.
      J1=I-1
      IF(J1.LT.1) GO TO 30
      DO 20 J=1,J1
      IJ=I-J+1
20    W(I)=W(I)+APREV(J)*R(IJ)
30    W(I)=(-W(I)-R(I+1))/RES
35    A(I)=W(I)
      J1=I-1
      IF(J1.LT.1) GO TO 50
      DO 40 J=1,J1
      IJ=I-J
40    A(J)=APREV(J)+W(I)*APREV(IJ)
50    RES=(1.-W(I)*W(I))*RES
      DO 60 L=1,I
60    APREV(L)=A(L)
      I=I+1
      IF(I.LE.M)GO TO 10
      RETURN
      END
C
C                    APPENDIX B
C
C
C                    LPC ANALYSIS PROGRAM
C
C
CC
       SUBROUTINE LPCR(W,A)
C
C
C
C    PARCOR COEFFICIENTS TO LPC COEFFICIENTS
C         W=PARCOR COEFFICIENTS, REFLECTION COEFFICIENTS
C              W(I),I=1,...,12
C         A=LPC COEFFICIENTS,  A(1).NE.1, A(I),I=1,...,12
C
C
CC
         DIMENSION W(13),A(13),APREV(14)
         M=12
       I=1
       RES=0.
 35    A(I)=W(I)
       J1=I-1
       IF(J1.LT.1) GO TO 50
       DO 40 J=1,J1
       IJ=I-J
 40    A(J)=APREV(J)+W(I)*APREV(IJ)
       RES=(1.-W(I)*W(I))*RES
       DO 60 L=1,I
 60    APREV(L)=A(L)
       I=I+1
       IF(I.LE.M) GO TO 35
       RETURN
       END
```

```
C                    APPENDIX C
C
C
C       FORTRAN SUBROUTINE FOR SPECTRAL BIT ASSIGNMENT
C
C       USAGE:  CALL BITASG(VPRIME,V,B)
C
C       ARGUMENTS:
C       INPUT:  VPRIME: -N WEIGHTED SPECTRAL LEVELS
C       INPUT:  V:      -N NORMALIZED SPECTRAL LEVELS
C       OUPUT:  B:      -BIT ASSIGNMENT
C
C       PARAMETERS USED:
C       N=TRANSFORM SIZE   (256)
C       NBGES=NO. OF BITS/BLOCK   (200)
C       IMAX=MAX. NO.OF BITS/COEFFICIENT   (5)
C
C       METHOD:
C       ITERATIVE TECHNIQUE BY P. NOLL AND
C       R. ZELINSKY BASED ON ADAPTATION OF
C       PARAMETER D** AS DEFINED IN L. DAVINSON'S
C       "RATE DISTORTION THEORY AND APPLICANTION",PROC.
C       IEEE,JULY 1972.OPTIMIZED FOR MAX-LOYD QUANTI-
C       ZERS AND GAUSSIAN SIGNALS.
CC
        SUBROUTINE BITASG(VPRIME,V,B)
        DIMENSION VPRIME(256),V(256),RA(256)
        INTEGER B(256)
C
C       DEFINE PARAMETERS
        N=256
        NBGES=200
        IMAX=5
      XN=FLOAT(N)
      RATE=FLOAT(NBGES)/XN
      X2=1./ALOG(2.)
C
C       COMPUTE BIT ASSIGNMENT SO AS TO MINIMIZE
C       DISTORTION ASSUMING NO FREQUENCY WEIGHTING.
C
      SUM=0.
      DO 10 I=1,N
      RA(I)=X2*ALOG(VPRIME(I))
10    SUM=SUM+RA(I)
      SUM=SUM/XN
      DO 20 I=1,N
20    RA(I)=RATE+RA(I)-SUM
C
C       SET BIT ASSIGNMENTS LESS THAN -.5 TO ZERO
C       AND UNIFORMLY REDISTRIBUTE BITS ACROSS BIT
C       ASSIGNMENTS GREATER THAN -.5
C
45    RNEG=0.
      INEG=0
      DO 50 I=1,N
      IF(RA(I).GT.-0.499) GOTO 50
      INEG=INEG+1
```

```
      RNEG=RNEG+RA(I)
      B(INEG)=I
      RA(I)=0.
50    CONTINUE
      IF(INEG.EQ.0) GOTO 80
      DEL=RNEG/FLOAT(N-INEG)
      B(INEG+1)=1100
      IND=1
      DO 60 I=1,N
      IF(I.EQ.B(IND)) GO TO 55
      RA(I)=RA(I)+DEL
      GOTO 60
55    IND=IND+1
60    CONTINUE
      GOTO 45
80    CONTINUE
C
C       SET BIT ASSIGNMENTS > THAN (IMAX+.5) TO
C       IMAX AND UNIFORMLY REDISTRIBUTE BITS ACROSS
C       BIT ASSIGNMENTS <= (IMAX+.5)
C
83    XIM=FLOAT(IMAX)
      RGR=XIM+0.499
90    RPOS=0.
      IPOS=0
      DO 100 I=1,N
      IF(RA(I).LT.RGR) GOTO 100
      IPOS=IPOS+1
      RPOS=RPOS+RA(I)-XIM
      RA(I)=XIM
      B(IPOS)=I
100   CONTINUE
      IF(IPOS.EQ.0) GOTO 130
      DEL=RPOS/FLOAT(N-IPOS)
      B(IPOS+1)=1100
      IND=1
      DO 110 I=1,N
      IF(I.EQ.B(IND)) GOTO 105
      RA(I)=RA(I)+DEL
      GOTO 110
105   IND=IND+1
110   CONTINUE
      GOTO 90
130   CONTINUE
C
C       SET ALL BIT ASGS. IN THE INTERVAL
C       (-.5,0) EQUAL TO 0 AND ROUND POSITIVE
C       BITS TO NEAREST POSITIVE INTEGER.
C       STORE IN AUXLILIARY ARRAY RA THE RESULTING
C       QUANTIZATION ERROR .
C
      NSUM=0
      RS=0.
      DO 150 I=1,N
      RR=RA(I)
      RS=RS+RR
      IF(RR) 133,133,135
```

```
133   B(I)=0
      RA(I)=RR
      GOTO 140
135   RR=RR+0.5
      B(I)=IFIX(RR)
      RA(I)=RA(I)-FLOAT(B(I))
140   NSUM=NSUM+B(I)
150   CONTINUE
C
C       IF TOTAL # OF BITS EQUALS NBGES RETURN
C
      IF(NSUM-NBGES) 170,160,200
160   GOTO 250
C
C       IF TOTAL # OF BITS NSUM<NBGES, REDISTRIBUTE
C       REMAINING NREST TO THOSE BITS WITH GREATEST
C       QUANTIZATION ERROR RA.
C
170   NREST=NBGES-NSUM
      DO 185 KK=1,NREST
      RAMAX=-1.
      DO 180 I=1,N
      NI=B(I)
      IF(NI.EQ.IMAX) GOTO 180
      IF(RAMAX.GT.RA(I)) GOTO 180
      RAMAX=RA(I)
      IND=I
180   CONTINUE
      B(IND)=B(IND)+1
      RA(IND)=-2.
185   CONTINUE
      GOTO 250
C
C       IF TOTAL # OF BITS NSUM>NBGES STEAL BITS
C       AS NECESSARY,FROM THOSE BITS ASSIGNMENTS WITH
C       THE SMALLEST QUANTIZATION ERROR.
C
200   NREST=NSUM-NBGES
      DO 220 KK=1,NREST
      RAMIN=+1.
      DO 210 I=1,N
      NI=B(I)
      IF(NI.EQ.0) GOTO 210
      IF(RAMIN.LT.RA(I)) GOTO 210
      RAMIN=RA(I)
      IND=I
210   CONTINUE
      B(IND)=B(IND)-1
      RA(IND)=2.
220   CONTINUE
250   CONTINUE
999   RETURN
      END
```

We claim:

1. A speech signal processing circuit comprising:

means (101, 103) for sampling a speech signal at a predetermined rate;

means (105) for partitioning said speech signal samples into blocks;

means (107) responsive to each block of speech samples for generating a set of first signals each representative of a discrete frequency domain transform coefficient of said block of speech samples at a predetermined frequency;

means (134) responsive to said first signals for generating a set of adaptation signals; and means (109) jointly responsive to said adaptation signals and said first signals for producing a set of adaptively quantized discrete transform coefficient coded signals for said block; CHARACTERIZED IN THAT said adaptation signal generating means (134) includes means (115, 124, 126) for generating a set of second signals representative of the formant spectrum of said block first signals;

means (117, 128) for generating a set of third signals representative of the pitch excitation spectrum of said block first signals;

means (130) for combining said set of second signals and said set of third signals to form a set of first pitch excitation controlled spectral level signals for said block first signals; and means (132) responsive to said first pitch excitation controlled spectral level signals for producing said adaptation signals.

2. A speech processing circuit according to claim 1 wherein said adaptation signal producing means (132) is CHARACTERIZED IN THAT a bit assignment signal and a step-size control signal for each first signal frequency are generated responsive to said first pitch excitation controlled spectral level signals; said bit assignment signals and said step-size control signals being applied to said adaptively quantized discrete transform coefficient coded signal producing means (109).

3. A speech processing circuit according to claim 2 further CHARACTERIZED IN THAT means (113) responsive to said block first signals are operative to form a signal representative of the autocorrelation of said block first signals;

said second signal generating means (115, 124, 126) being responsive to said autocorrelation representative signal to generate a formant spectral level signal at each first signal frequency;

said third signal generating means (117, 128) being responsive to said autocorrelation representative signal to generate a pitch excitation spectral level signal at each first signal frequency; and said combining means (130) being operative to combine the formant spectral level and the pitch excitation spectral level signals at each first signal frequency to form a first pitch excitation controlled spectral level signal at each first signal frequency.

4. A speech signal processing circuit according to claim 3 further CHARACTERIZED IN THAT said third signal generating means (117, 128) comprises:

means (117, FIG. 6, FIG. 7) responsive to said block autocorrelation representative signal for forming an impulse train signal representative of the pitch excitation of said block first signals; and means (FIG. 8) responsive to said pitch representative impulse train signal for generating a set of signals each representative of the pitch excitation spectral level at a first signal frequency.

5. A speech signal processing circuit according to claim 4 wherein said second signal generating means (115, 124, 126) is CHARACTERIZED BY means (115, 124) responsive to said block autocorrelation representative signal for generating a set of signals representative of the prediction parameters of said block first signals; and means (126) responsive to said prediction parameter signals for generating a formant spectral level signal at each first signal frequency.

6. A speech signal processing circuit according to claim 5 wherein said pitch representative impulse train signal forming means (117, FIG. 6, FIG. 7) is CHARACTERIZED BY means (603, 605, 607) responsive to said block autocorrelation signal for determining a signal ($R_{max}$) corresponding to the maximum value of said autocorrelation signal in said block and a pitch period signal (P) corresponding to the time of occurrence of said maximum value of said autocorrelation signal;

means (609) responsive to said determined autocorrelation signal maximum value ($R_{max}$) and the initial value of said block autocorrelation signal (R(0)) in said block for forming a pitch gain signal ($P_G$) corresponding to the ratio of said autocorrelation signal maximum value to said autocorrelation signal initial value; and means (701, 703, 707, 709, 713, 715-0-715-N−1) jointly responsive to said pitch gain and said pitch period signal for generating said pitch representative impulse train signal $$Z(n)=P_G^k$$

for $n=kP+P/2$ and zero for all other $n < N-1$; where $n=0,1,2,\ldots,N-1$; $k=0,1,\ldots,(N-1-P/2)/P$ and N is the number of discrete cosine transform coefficients.

7. A speech processing circuit according to claim 6 further comprising:

means (112) for multiplexing said adaptively quantized discrete transform coefficient coded signals, said prediction parameter signals, said pitch period signal and said pitch gain signal for said block of first signals;

means (201) connected to said multiplexing means (112) for separating the adaptively quantized discrete transform coefficient coded signals of said block from said prediction parameter signals, said pitch period signal and said pitch gain signal of said block;

means (234) responsive to said block prediction parameter signals, said pitch period signal and said pitch gain signal from said separating means (201) for forming a set of adaptation signals for said block;

means (203) jointly responsive to said adaptively quantized discrete transform coefficient coded signals of said block and said adaptation signals from said adaptation signal forming means (234) for decoding said block adaptively quantized discrete transform coefficient coded signals;

means (207) responsive to said set of decoded discrete cosine transform coefficient coded signals from said decoding means (203) for producing a set of fourth signals representative of the speech samples of the block; and means (208, 209, 211) for converting said fourth signals into a replica of said sampled speech signals CHARACTERIZED IN THAT said adaptation signal forming means (234) comprises:

means (222, 224, 226) responsive to said prediction parameter signals from said separating means (201) for generating a set of fifth signals representative of the formant spectrum of said block first signals;

means (222, 228) responsive to said pitch period and pitch gain signals from separating means (201) for generating a set of sixth signals representative of the pitch excitation spectrum of said block first signals;

means (230) for combining said sets of fifth and sixth signals to form a set of second pitch excitation controlled spectral level signals for said block; and adaptation computing means (232) responsive to said set of second pitch excitation controlled spectral level signals for generating a bit assignment signal and a step-size control signal for each adaptively quantized discrete transform coefficient coded signal.

8. A speech signal processing circuit according to any of claims 1 through 7 further CHARACTERIZED IN THAT each first signal is representative of a discrete cosine transform coefficient of said block of speech samples at a predetermined frequency; and each adaptively quantized discrete transform coefficient coded signal is an adaptively quantized discrete cosine transform coefficient coded signal.

9. A method for processing a speech signal comprising the steps of:

sampling a speech signal at a predetermined rate;

partitioning said speech signal samples into blocks;

responsive to each block of speech signal samples, generating a set of first signals each representative of a discrete frequency domain transform coefficient of said block of speech samples at a predetermined frequency;

forming a set of first adaptation signals from said block first signals; and producing a set of adaptively quantized discrete transform coefficient coded signals for each block jointly responsive to said set of first adaptation signals and said block first signals CHARACTERIZED IN THAT:

the forming of said first adaptation signals includes generating a set of second signals representative of the formant spectrum of the block first signals;

generating a set of third signals representative of the pitch excitation spectrum of the block first signals;

combining said second and third signals to form a set of first pitch excitation controlled spectral level signals; and generating a set of first adaptation signals responsive to said first pitch excitation controlled spectral level signals.

10. A method for processing a speech signal according to claim 9 wherein said adaptation signal generation is CHARACTERIZED IN THAT:

a bit assignment signal and a step-size control signal for each first signal frequency is generated responsive to said first pitch excitation controlled spectral level signal at said first signal frequency, said bit assignment and step-size control signals being the first adaptation signals for adaptively quantizing said first signals.

11. A method for processing a speech signal according to claim 10 further CHARACTERIZED IN THAT:

said set of second signals is generated by forming a signal representative of the autocorrelation of the block first signals and generating a formant spectral level signal at each first signal frequency from said autocorrelation representative signal;

said set of third signals is generated by producing a pitch excitation spectral level signal at each first signal frequency responsive to said autocorrelation representative signal; and combining the pitch excitation spectral level signal and the formant spectral level signal for each first signal frequency to produce a first pitch excitation controlled spectral level signal at said first signal frequency.

12. A method for processing a speech signal according to claim 11 wherein said pitch excitation spectral level signal formation is CHARACTERIZED IN THAT:

an impulse train signal representative of the pitch excitation of said block first signals is formed responsive to said autocorrelation representative signal; and responsive to said impulse train signal, a set of signals each representative of the pitch excitation spectral level at a first signal frequency is generated.

13. A method for processing a speech signal according to claim 12 wherein the forming of said second signals is CHARACTERIZED IN THAT:

a set of signals representative of the prediction parameters of said block first signals is formed from said autocorrelation representative signal; and said formant spectral level signals are generated responsive to said block prediction parameter signals.

14. A method for processing a speech signal according to claim 13 wherein the forming of said pitch excitation impulse train signal is CHARACTERIZED IN THAT:

a signal ($R_{max}$) representative of the maximum value of said autocorrelation signal in said block and a pitch period signal (P) corresponding to the time of occurrence of said maximum value aotocorrelation signal are determined;

responsive to said determined maximum autocorrelation signal and the initial value of said autocorrelation signal in said block, a pitch gain signal $P_G$ corresponding to the ratio of said maximum value autocorrelation signal to said initial value of said autocorrelation signal is formed; and jointly responsive to said pitch gain signal and said pitch period signal, an impulse train signal $$Z(n)=P_G^k$$

for $n=kP+P/2$ and zero for all other $n<N+1$; where $n=0,1,\ldots,N-1$, $k=0,1,\ldots,(N-1-P/2)/P$ and N is the number of discrete cosine transform coefficients in said block, is generated.

15. A method for processing a speech signal according to claim 14 further comprising the steps of:

multiplexing said adaptively quantized discrete transform coefficient coded signals, said prediction parameter signals, said pitch period signal and said pitch gain signal for said block of first signals;

applying said multiplexed signals to a communication channel;

separating the multiplexed adaptively quantized discrete transform coefficient coded signals of the block from the multiplexed prediction parameter signals, the pitch period signal and the pitch gain signal;

responsive to the separated prediction parameter signals, pitch period signal and pitch gain signal, forming a set of second adaptation signals for the block;

jointly responsive to said adaptively quantized discrete transform coefficient coded signals of said block and said second adaptation signals, decoding said separated block adaptively quantized discrete transform coefficient coded signals;

producing a set of fourth signals representative of the speech samples of the block from said decoded adaptively quantized discrete transform coefficient coded signals; and converting said fourth signals into replica of said spech signal samples;

CHARACTERIZED IN THAT the forming of said second adaptation signals includes:

generating a set of fifth signals representative of the formant spectrum of the block first signals responsive to the separated prediction parameter signals;

generating a set of sixth signals representative of the pitch excitation spectrum of said block first signals from the separated pitch period and pitch gain signals;

combining the sets of fifth and sixth signals to form a set of second pitch excitation controlled spectral level signals for said block; and responsive to said second pitch excitation controlled spectral level signals, producing a bit assignment adaptation signal and a step-size control adaptation signal for each adaptively quantized discrete transform coefficient coded signal.

16. A method for processing a speech signal according to any of claims 9 through 15 further CHARACTERIZED IN THAT each first signal is representative of a discrete cosine transform coefficient of said block of speech samples at a predetermined frequency; and each adaptively quantized discrete transform coefficient coded signal is an adaptively quantized discrete cosine transform coefficient coded signal.

* * * * *

UNITED STATES PATENT AND TRADEMARK OFFICE

CERTIFICATE OF CORRECTION

PATENT NO. : 4,184,049

DATED : January 15, 1980

INVENTOR(S) : Ronald E. Crochiere and Jose M. N. S. Tribolet

It is certified that error appears in the above-identified patent and that said Letters Patent are hereby corrected as shown below:

Column 1, line 8, "speed" should read --speech--; line 9, "speed" should read --speech--. Column 6, line 43, "$\sqrt{2/N}$" should read --$\sqrt{2/N}$--. Column 8, line 29, "$X_{DCT}2$" should read --$X^2_{DCT}$--; line 33, "$X_{DCT}2$" should read --$X^2_{DCT}$--. Column 9, line 30, that portion of the formula reading "$w_m$," should read --$w_{m'}$--. Column 13, line 58, "$P_G$" should read --$P'_G$--; line 65, "P´2" should read --P´/2--. Column 15, line 66, that portion of the formula reading "$P_{\sigma j}$" should read --$P_{\sigma_j}$--. Column 17, line 3, "$\geqq$" should read --<--. Column 18, line 30, "format" should read --formant--. Column 19, line 10, "interfaces" should read --interface--. Column 24, line 28, "W(K)" should read --W(κ)--.

Signed and Sealed this

*Nineteenth* Day of *August 1980*

[SEAL]

*Attest:*

SIDNEY A. DIAMOND

*Attesting Officer*

*Commissioner of Patents and Trademarks*